US008362381B2

(12) United States Patent
Itou

(10) Patent No.: US 8,362,381 B2
(45) Date of Patent: Jan. 29, 2013

(54) SWITCH MECHANISM AND ELECTRONIC DEVICE

(75) Inventor: Takeshi Itou, Tokyo (JP)

(73) Assignee: NEC Corporation, Tokyo (JP)

( * ) Notice: Subject to any disclaimer, the term of this patent is extended or adjusted under 35 U.S.C. 154(b) by 282 days.

(21) Appl. No.: 12/920,441

(22) PCT Filed: Mar. 2, 2009

(86) PCT No.: PCT/JP2009/053842

§ 371 (c)(1),
(2), (4) Date: Aug. 31, 2010

(87) PCT Pub. No.: WO2009/110420

PCT Pub. Date: Sep. 11, 2009

(65) Prior Publication Data

US 2011/0000775 A1 Jan. 6, 2011

(30) Foreign Application Priority Data

Mar. 6, 2008 (JP) ..... 2008-056537

(51) Int. Cl.
*H01H 1/10* (2006.01)

(52) U.S. Cl. ..... 200/512

(58) Field of Classification Search ..... 200/512, 200/520, 5 A, 517, 341
See application file for complete search history.

(56) References Cited

U.S. PATENT DOCUMENTS

| | | | | |
|---|---|---|---|---|
| 6,133,536 | A * | 10/2000 | Hunag et al. | 200/5 A |
| 7,146,701 | B2 * | 12/2006 | Mahoney et al. | 29/458 |
| 7,164,091 | B2 * | 1/2007 | Lu | 200/292 |
| 2003/0029704 | A1 * | 2/2003 | Meagher et al. | 200/61.73 |
| 2007/0235312 | A1 * | 10/2007 | Takeuchi | 200/520 |
| 2010/0187084 | A1 * | 7/2010 | Suzuki et al. | 200/520 |
| 2011/0036701 | A1 * | 2/2011 | Wang | 200/512 |

FOREIGN PATENT DOCUMENTS

| | | |
|---|---|---|
| JP | 1-221824 | 9/1989 |
| JP | 11-26166 | 1/1999 |
| JP | 2005-317337 | 11/2005 |
| JP | 2006-59709 | 3/2006 |
| JP | 2006-140048 | 6/2006 |
| JP | 2007-109486 | 4/2007 |
| JP | 2007-213874 | 8/2007 |

OTHER PUBLICATIONS

International Search Report dated Apr. 14, 2009.

* cited by examiner

*Primary Examiner* — Edwin A. Leon
(74) *Attorney, Agent, or Firm* — Scully, Scott, Murphy & Presser PC

(57) ABSTRACT

A switch mechanism having a switch button(s) to be pushed, a support board having a projecting portion(s) at a position corresponding to the switch button(s), and a switching assembly that is provided between the switch button and the support board and that switches an electrical connection state with the projecting portion in a state where the switch button is pushed. The support board having a through hole(s) around a position corresponding to the projecting portion. The through hole(s) is(are) formed such that the projecting portion is displaced in a pushing direction of the switch button in the state where the switch button is pushed.

13 Claims, 34 Drawing Sheets

Prior Art

Prior Art

SWITCH MECHANISM AND ELECTRONIC DEVICE

TECHNICAL FIELD

Related Application

This application claims the benefit of Japanese Patent Application No. 2008-056537, filed on Mar. 6, 2008, which is hereby incorporated by reference herein in its entirety.

This invention relates to a switch mechanism and an electronic device comprising the switch mechanism and, in particular, relates to a switch mechanism of a push button type and an electronic device comprising the switch mechanism.

BACKGROUND

In an electronic device represented by a mobile terminal, recently, there is a tendency to a technical development which is specialized in added value of a slim/small type for portability. Therefore, sliming a switch structure for operating the device by a user has been tackled (see Patent Document 1 and Patent Document 2, for example).

A key switch structure described in Patent Document 1 has a film-shaped member on which a plurality of keytops are fixed; push elements are located on a side opposite to a surface on which the keytops of the film-shaped member are fixed; and a switch provided on a board is pushed through a push element by pushing the keytop down.

A key sheet described in Patent Document 2 comprises a film sheet having flexibility, a plurality of keytops provided on a surface of the film sheet, and a plurality of push elements fixed to the film sheet with a non-thermo-curing material at positions corresponding to the keytops on the backside of the film sheet.

[Patent Document 1]

Japanese Patent Kokai Publication No. P2007-109486A

[Patent Document 2]

Japanese Patent Kokai Publication No. P2007-213874A

The following analysis is given from a viewpoint of the present invention.

FIGS. 33 and 34 illustrate schematic cross-sectional views of a switch mechanism in which a dish-shaped conductor (metal dome) is convex downward (a convex portion faces toward an opposite side of a switch button), and a projection portion for pushing the conductor is under the conductor (a convex portion of a projecting body faces toward the switch button), and that is different from the background arts shown in Patent Document 1 and Patent Document 2. FIG. 33 is a schematic cross-sectional view of the switch mechanism in a state where a switch button 410 is not depressed, and FIG. 34 is a schematic cross-sectional view of the switch mechanism in a state where the switch button 410 is depressed. In the switch mechanism 401, a conductor 404 is disposed under a circuit board 405 and is in contact with a second electrode 407, and a support board 402 having a projecting portion 402*a* is disposed under the conductor 404.

In the switch mechanism 401, when the switch button 410 is depressed, the circuit board 405 and the conductor 404 are displaced toward the projecting portion 402*a*. The central part of the dish-shaped conductor 404 is pushed by the projecting portion 402*a*, and the conductor 404 changes its shape so as to protrude the central part. The protruded central part comes into contact with a first electrode 406, and the first electrode 406 and the second electrode 407 can make electrical connection with each other thereby.

However, not only the circuit board 405 but also the switch button 410 changes its shape according to the shape of the projecting portion 402*a*. If the support board 402 (projecting portion 402*a*) is made of metal, and the switch button 410 is made of resin, for example, since the rigidity of the switch button 410 is less than that of the projecting portion 402*a*, depressing the switch button 410 deforms the switch button 410 to a mountain shape. This causes stress in the central part (indicated by a circle) of switch button 410. If the depressing of the switch button 410 and its release are repeated, the deformation of the switch button 410 to the mountain shape and deformation to the original shape are repeated, resulting in damage by fatigue at the central part of switch button 410. As to a switch button 410 which is made slim in order to slim the switch mechanism 401, in particular, the switch button 410 is damaged by fatigue more easily.

In the key switch structure described in Patent Document 1 and the key sheet described in Patent Document 2 which have a structure such that the convex portion and the conductor are upside down as compared with a switch mechanism illustrated in FIG. 33, there is also a probability that a central part of the keytop (switch button) is damaged by fatigue. In the key switch structure described in Patent Document 1 and the key sheet described in Patent Document 2, if an illumination sheet that illuminates the switch button is provided, it is preferred that the illumination sheet is disposed between the keytop and the push element (projecting portion) and, however, in that structure, since the illumination sheet is apart from the printed circuit board, both a wiring structure for power supply and assembling work become complicated.

In the switch mechanism illustrated in FIG. 33, the key switch structure described in Patent Document 1 and the key sheet described in Patent Document 2, if the conductor (metal dome) is made thin in order to slim the switch mechanism, a stroke for getting a predetermined electrical connection at the time of pushing the switch button becomes short and operational feeling upon depressing the switch button, that is, a feeling to perceive depressing the button for a user becomes dull.

It is an object of the present invention to provide a switch mechanism in which durability of a switch button is enhanced, operational feeling is improved, and structure and assembling are made simple.

According to a first aspect of the present invention, a switch mechanism is provided, the switch mechanism comprising: a circuit board having at least one first electrode and at least one second electrode on one surface side, at least one switch button that is provided on the other surface side of the circuit board and operated by being pushed from the outside, at least one conductor provided at a position corresponding to the first electrode and the second electrode on the one surface side of the circuit board, and a support board that has at least one projecting portion at a position corresponding to the at least one switch button, and that is provided such that the conductor is provided between the support board and the circuit board. In a state where the switch button is not pushed, the conductor is not in contact with the first electrode but in contact alone with the second electrode. In a state where the switch button is pushed, the conductor is brought into contact with the first electrode by being supported with the projecting portion, and electrically connects the first electrode with the second electrode. The support board has at least one through hole around the projecting portion. The through hole is formed such that the projecting portion is displaced in a pushing direction of the switch button along with pushing operation of the switch button.

According to a preferred mode of the first aspect, when the pushing operation of the switch button is canceled, the position of the projecting portion is restores to an original position.

According to a preferred mode of the first aspect, the projecting portion is displaced by 0.05 mm to 0.15 mm in the pushing direction by the pushing operation of the switch button.

According to a preferred mode of the first aspect, a plurality of the through holes are formed so as to surround the projecting portion.

According to a preferred mode of the first aspect, the through hole is of a spiral form and formed so as to surround the projecting portion.

According to a preferred mode of the first aspect, the through hole(s) is(are) formed in a radial manner around the projecting portion.

According to a preferred mode of the first aspect, the support board is made from stainless steel.

According to a preferred mode of the first aspect, the conductor has a dish shape. A concave surface of the conductor faces the circuit board. The pushing operation of the switch button protrudes a part of the concave surface of the conductor toward the circuit board by pushing of the projecting portion to bring the conductor into contact with the first electrode.

According to a preferred mode of the first aspect, the switch button is made from resin.

According to a second aspect of the present invention, an electric device comprising a switch mechanism is provided. The switch mechanism comprises a circuit board having at least one first electrode and at least one second electrode on one surface side; at least one switch button provided on the other surface side of the circuit board and operated by being pushed from the outside; at least one conductor provided at a position corresponding to the first electrode and the second electrode on the one surface side of the circuit board; and a support board that has at least one projecting portion at a position corresponding to the at least one switch button, and that is provided such that the conductor is provided between the support board and the circuit board. In a state where the switch button is not pushed, the conductor is not in contact alone with the first electrode but in contact with the second electrode. In a state where the switch button is pushed, the conductor is brought into contact with the first electrode by being supported with the projecting portion, thereby electrically connecting the first electrode with the second electrode. The support board has at least one through hole around the projecting portion. The through hole is formed such that the projecting portion is displaced in a pushing direction of the switch button along with pushing operation of the switch button.

According to a preferred mode of the second aspect, the support board is a part of a housing to accommodate a built-in component(s) of the electronic device.

The present invention possesses at least one among the following effects.

According to the present invention, a projecting portion is displaced in the pushing direction by pushing (depressing) a switch button, and this can restrain the shape of the switch button from changing corresponding to the projecting portion. Therefore, stress generated in the switch button can be reduced, and fatigue rupture of the switch button can be restrained.

According to the present invention, the projecting portion is displaced in the pushing direction by pushing the switch button, and this can make a great difference (change) in a repulsive force that the user feels. Therefore, the user can get clear operational feeling even if moveable stroke of the conductor is short.

According to the present invention, an illumination sheet can be provided between the switch button and a circuit board, and this can simplify the structures of the switch button and electronic device and make the manufacture thereof easy.

According to the present invention, the durability of the switch mechanism can be improved, and good click feeling can be maintained.

As for explanations of symbols, refer to the end of the specification.

Preferred Modes

Figure 1:
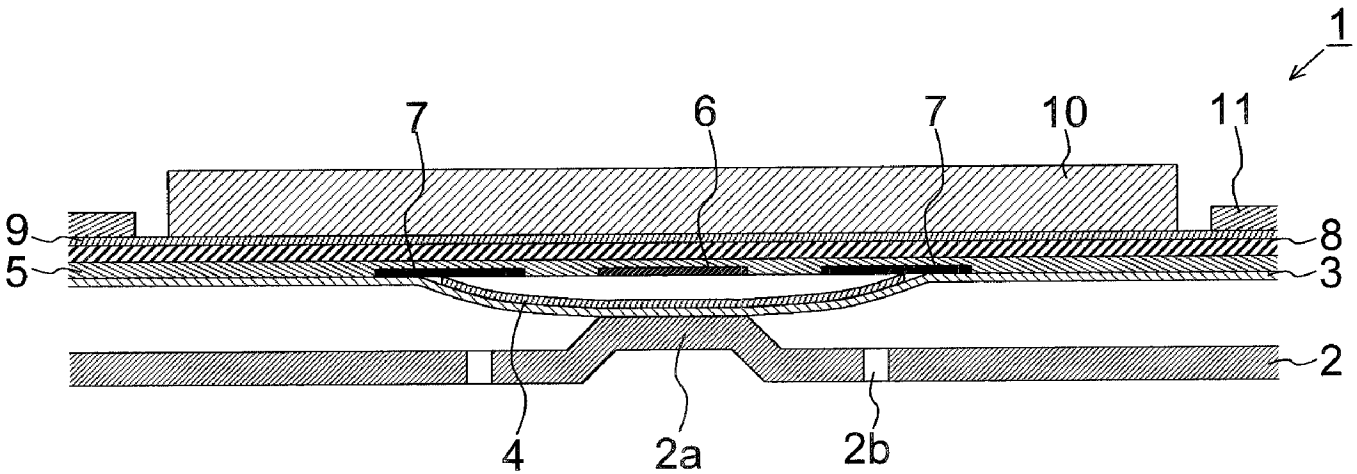
FIG. 1 is a partial and schematic cross-sectional view of a switch mechanism according to a first exemplary embodiment of the present invention.

A switch mechanism according to a first exemplary embodiment of the present invention will be explained. FIG. 1 illustrates a partial and schematic cross-sectional view of the switch mechanism according to the first exemplary embodiment of the present invention. FIG. 1 is the schematic cross-sectional view of one switch button.

The switch mechanism 1 comprises a support boar 2, an adhesive sheet 3, at least one conductor 4, a circuit board that has a first electrode 6 and second electrode 7, an illumination sheet 8, a thin sheet 9, at least one switch button 10 and a cover member 11.

The switch button 10 is a button for a user's input operation and is joined to a predetermined position on the thin sheet. The switch button 10 may be made of resin such as acrylic, polycarbonate and the like, for example and, in this case, may be made by injection molding, for example. The switch button 10 may have a thickness of about 0.3 mm, for example. The thin sheet 9 may be made of a resin such as polycarbonate and the like, for example, and may have a thickness of about 0.05 mm, for example. The cover member 11 that has a through hole to insert the switch button 10 is provided on the thin sheet 9. The cover member 11 is not necessarily provided between adjacent switch buttons 10.

The illumination sheet 8 is provided to illuminate the switch button 10 under the switch button 10 and thin sheet 9. As the illumination sheet 8, an inorganic EL sheet may be used, for example, and have a thickness of about 0.1 mm, for example. As the illumination sheet 8, a light-guiding sheet that has a light source such as an LED at an end, guides the light into the illumination sheet 8 and illuminates a desired point may be used.

The circuit board 5 is preferably provided below the switch button 10, is preferably possible to deform according to movement of the switch button 10 when the switch button 10 is pushed (depressed), and is preferably formed as a flexible board (FPC), for example. In the circuit board 5, the first electrode 6 and the second electrode 7 of a ring form surrounding the first electrode are formed for every switch button 10. The conductor 4 is provided every switch button 10 and electrically connects the first electrode 6 with the second electrode 7 when the switch button 10 is pushed. In a mode illustrated in FIG. 1, the conductor 4 is held under the first electrode 6 and second electrode 7 by the adhesive sheet 3 such that at least a part of the end part (peripheral part) of the conductor 4 is in contact with the second electrode 7. In a state where the switch button 10 is not pushed (depressed), the conductor 4 is not in contact with the first electrode 6. The conductor 4 is preferably a metal plate of a dish shape (disc spring, metal dome), and the concave surface faces the circuit board 5. The conductor 4 is disposed such that the central part (most recessed region, preferably) is located below the first electrode 6 and preferably that a center of the first electrode 6 overlaps with a center of the conductor 4. The conductor 4 preferably has a flexibility or elasticity such that the central part 4*a* protrudes when the convex surface is pushed (depressed) and restores the original shape when pushing is released. In the mode illustrated in FIG. 1, the conductor 4 is held by the adhesive sheet 3 such that at least a part of the peripheral part (end part) 4*b* is in electrical contact with the second electrode 7. In a state where the switch button 10 is not pushed, the central part (most recessed region, preferably) 4*a* of the conductor 4 is not in contact with the first electrode 6. The central part 4*a* of the conductor 4 is disposed below the first electrode 6 and, preferably, disposed such that the center of the first electrode 6 overlaps with the center of the conductor 4. In a state where the switch button 10 is pushed, the conductor 4 comes in contact with the first electrode 6 by supporting the central part 4*a* with the projecting portion 2*a* of the support board 2, and electrically connects the first electrode 6 with the second electrode 7. When pushing the switch button 10 is released, the conductor 4 restores the original shape.

The illumination sheet 8 to illuminate the switch button 10 is layered between the circuit board 5 and the switch button 10. On the illumination sheet 8, the thin sheet 9 to which the switch button 10 is joined is laminated. The switch button 10 is disposed above the first electrode 6 and second electrode 7. On the thin sheet 9, the cover member 11 that has a through hole to insert the switch button 10 is provided.

Figure 2:
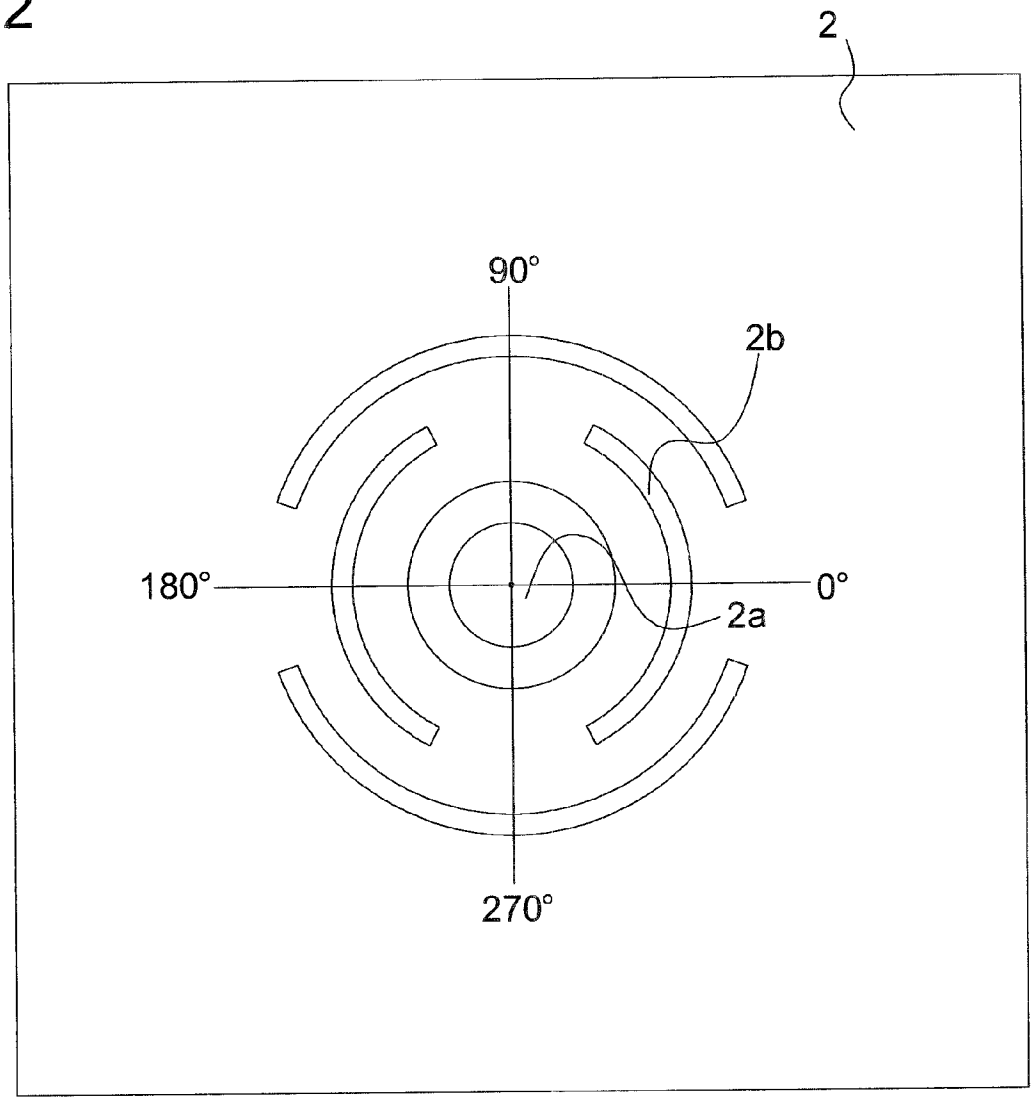
FIG. 2 is a partial and schematic plan view of a support board in a switch mechanism according to a first exemplary embodiment illustrated in FIG. 1.

Under the adhesive sheet 3, the support board 2 is provided. FIG. 2 illustrates a partial and schematic plan view of the support board in the switch mechanism according to the first exemplary embodiment illustrated in FIG. 1. FIG. 2 is the schematic plan view of the periphery of one projecting portion 2*a*. The support board 2 has the projecting portion 2*a* below the first electrode 6. The projecting portion 2*a* preferably has a fat upper part and, for example, has a shape of a truncated cone. The upper surface of the projecting portion 2*a* is preferably flat or of a gently curved surface and is preferably disposed below the first electrode 6. More preferably, the central part of the upper surface of the projecting portion 2*a*, the central part of the first electrode, and the most recessed region of the conductor 4 (the central part of the conductor 4) are disposed so as to be registered. The upper surface of the projecting portion 2*a* is preferably in contact with the adhesive sheet 3 in the state where the switch button 10 is not pushed.

A positional relation among the switch button 10, the first electrode 6, the conductor 4 and the projecting portion 2*a* of the support board 2 is determined such that, when the switch button 10 is pushed, the projecting portion 2*a* pushes and protrudes the central part 4*a* of the conductor 4 to electrically connect the protruded central part 4*a* of the conductor 4 with the first electrode 6.

The support board 2 further has at least one through hole 2*b* at a circumferential periphery of (around) the projecting portion 2*a*. The through hole 2*b* is formed such that, when the switch button 10 is pushed, the elasticity of the conductor 4 or the pushing force from the switch button 10 bends the support board 2 (deforms the support board 2) and that the projecting portion 2*a* descends. When the switch button 10 is pushed at 5 N to 50 N, for example, the through hole 2*b* may be formed such that the position of the projecting portion 2*a* is deformed by 0.05 mm to 0.15 mm. The through hole 2*b* is formed such that the projecting portion 2*a* restores the original shape when pushing the switch button 10 is released.

In the support board 2 illustrated in FIGS. 1 and 2, the through holes 2*b* are formed around the projecting portion 2*a*. In the mode illustrated in FIG. 2, a plurality of the through holes 2*b* of a circular arc shape are formed concentrically with the center of the projecting portion 2*a* in the support board 2. According to this exemplary embodiment, by forming the through holes 2*b* around the projecting portion 2*a*, the rigidity of the support board 2 is lowered and the region where the through holes 2*b* are formed is made easy to bend. Therefore, the operational feeling of the switch button 10 can be made clear and the stress that generates in the switch button 10 can be decreased.

The support board 2 is preferably made from a material that has the elasticity such that the support board 2 bends when the switch button 10 is pushed and restores the original the shape the pushing is released. For example, the support board 2 may be made of a plate metal such as stainless steel (SUS). If the support board 2 is made of the plate metal of stainless steel having a thickness of about 0.3 mm, for example, in a mode illustrated in FIG. 2, a through hole(s) of the circular arc shape having a radius of 1.0 mm, a central angle of 120° (300° to 60°), a width of 0.2 to 0.3 mm, a through hole(s) of the circular arc shape having a radius of 1.0 mm, a central angle of 120° (120° to 240°), a width of 0.2 to 0.3 mm, a through hole of a circular arc shape having a radius of 1.4 mm, a central angle of 120° (30° to 150°), a width of 0.2 to 0.3 mm, and a through hole(s) of the circular arc shape having a radius of 1.4 mm, a central angle of 120° (210° to 330°), a width of 0.2 to 0.3 mm may be made, for example.

The height of the projecting portion 2*a* is suitably determined according to the length of the stroke of the switch button 10. The height of the projecting portion 2*a* may be determined such that the length of the stroke of the switch button 10 is made to about 0.2 mm that is obtained by adding a margin to movable stroke (depth of the dish shape) of the conductor 4. The projecting portion 2*a* may have height of 0.05 mm to 0.25 mm from the surface of support board 2, for example. If the plane shape of the upper surface of the projecting portion 2*a* is circular as illustrated in FIG. 2, its diameter may be determined to 1.0 mm to 2.0 mm, for example.

The support board 2 is preferably integrally formed as a part of a housing that accommodates the switch mechanism 1 of the present invention and others. That is, the projecting portion 2*a* and through hole(s) 2*b* are preferably formed in a surface (undersurface) of the housing that serves as the support board.

Figure 3:
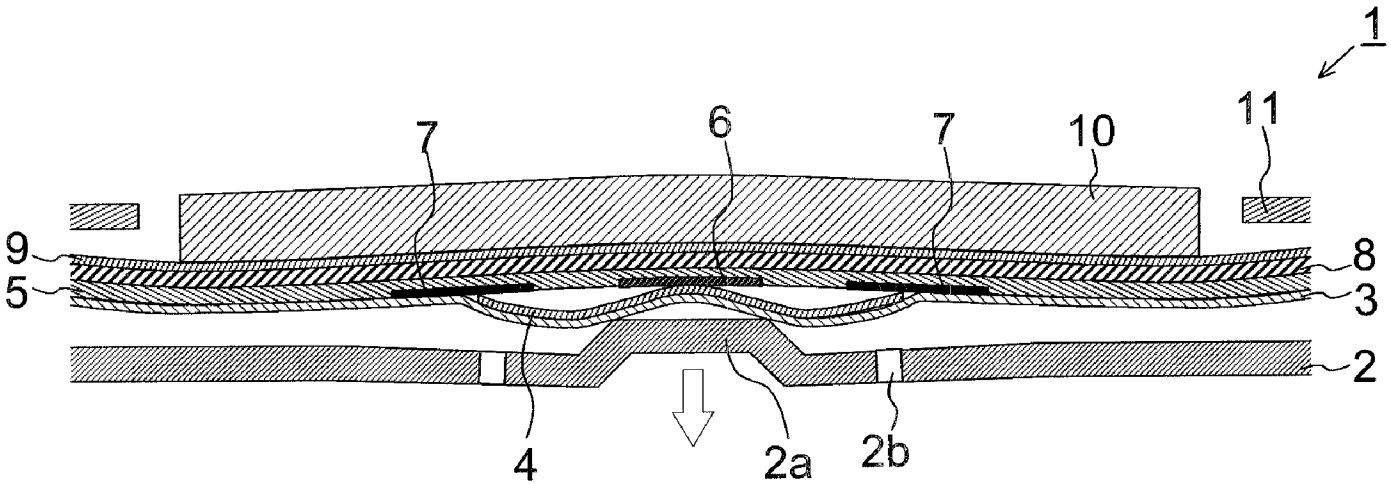
FIG. 3 is a partial and schematic cross-sectional view illustrating a state of a pushed switch button in a switch mechanism according to a first exemplary embodiment of the present invention.

FIG. 3 illustrates a partial and schematic cross-sectional view illustrating a state of the pushed (depressed) switch button in the switch mechanism according to the first exemplary embodiment of the present invention. When the user pushes the switch button 10, the circuit board 5, illumination sheet 8 and others are pushed toward the support board 2. This changes the position of the peripheral part of the conductor 4 that is in contact with the second electrode 7 downward. Since the central part of the conductor 4 is supported with the projecting portion 2*a*, the projecting portion 2*a* pushes the central part of the conductor 4 because of the movement of the peripheral part of the conductor 4, and the shape of the conductor is changed such that the central part of the concave surface is protruded. This brings the protruded central part of the conductor 4 into contact with the first electrode 6 of the circuit board and makes the electrical connection between the first electrode 6 and the second electrode 7. The projecting portion 2*a* serves to deform of the central part of the conductor 4 when the switch button 10 is pushed and has a function to make it easy to sense the operational feeling that the user of the switch button 10 pushes the switch button 10 by the repulsive force. When pushing the switch button 10 is released, the positions of the circuit board 5, illumination sheet 8 and others displace upward (restore the original positions). This releases the pushing of the projecting portion 2*a* of the support board 2 to the central part 4*a* of the conductor 4 and restores the conductor 4 to the original shape. When the conductor restores the original shape, the electrical connection between the first electrode 6 and the central part 4*a* of the conductor 4 is released.

The push operation of the switch button 10 bends the region of the support board 2 where the through hole 2*b* is formed and changes the position of the projecting portion 2*a* downward. This positional change has a function to give the clear operational feeling of the switch button 10 to the user during a period from a start of pushing the switch button 10 until the contact of the conductor 4 with the first electrode 6 and has a function to restrain the switch button 10 from being damaged by fatigue after the conductor 4 contacts with the first electrode 6. The effects of the bending of the region where the through hole 2*b* is formed will be explained separately before and after the contact of the conductor 4 and the first electrode 6.

Figure 4:
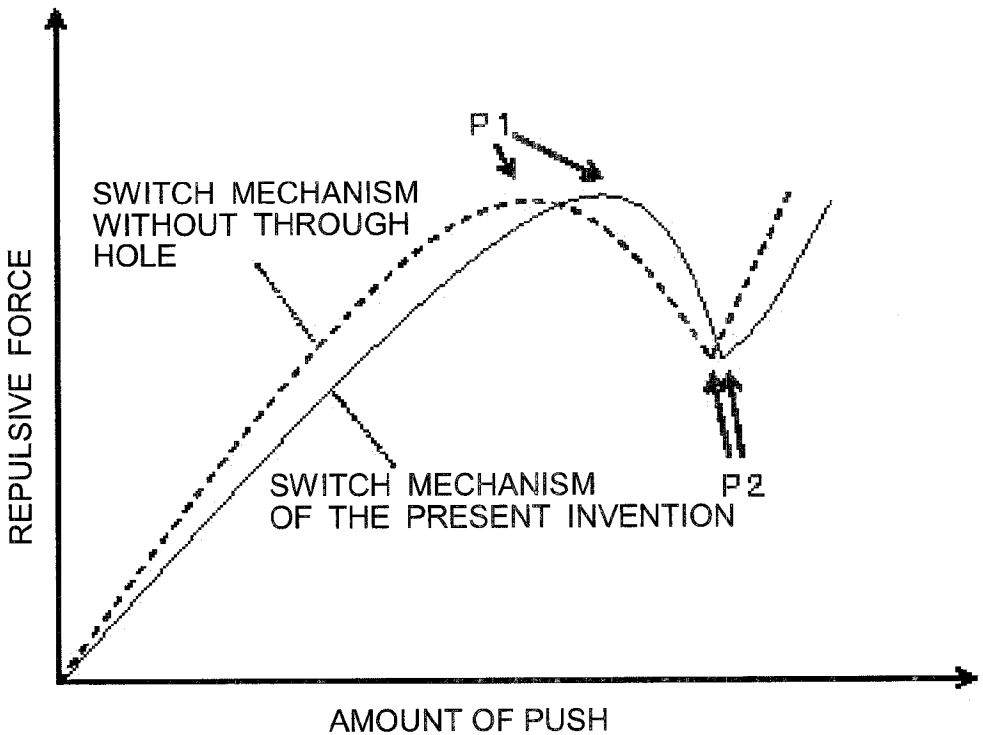
FIG. 4 is a comparative chart illustrating a relation between length of push of a switch button and repulsive force.
Figure 33:
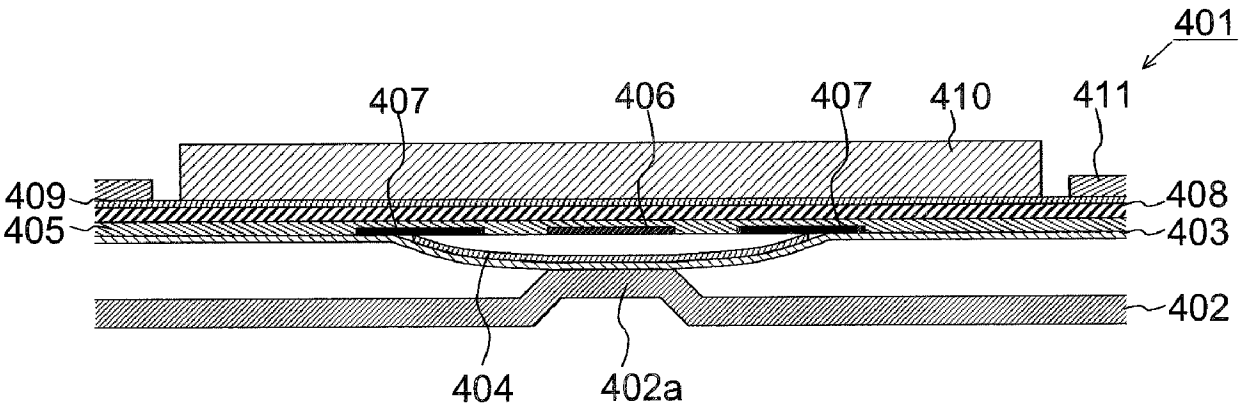
FIG. 33 is a partial and schematic cross-sectional view of a switch mechanism to explain a problem to be solved by the present invention.
Figure 34:
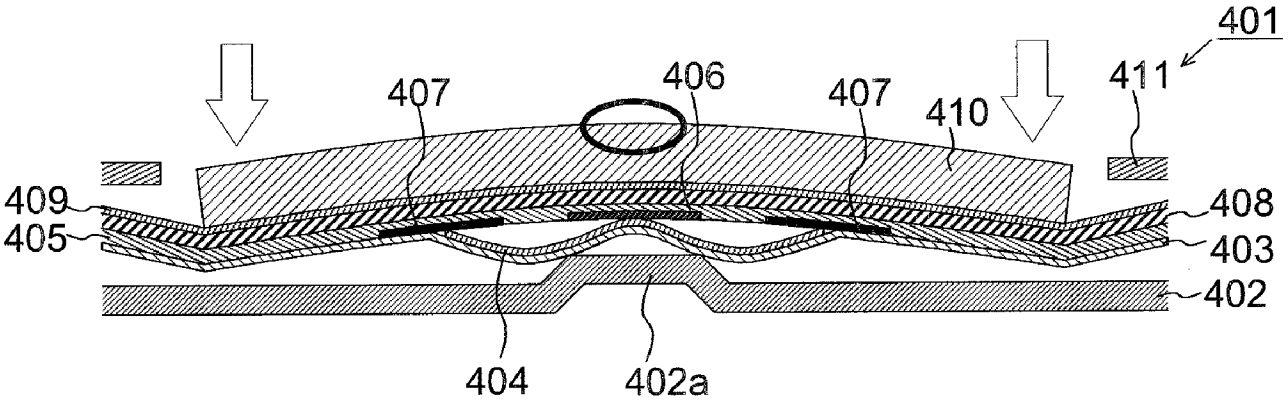
FIG. 34 is a partial and schematic cross-sectional view illustrating a state of a pushed switch button in a switch mechanism illustrated in FIG. 33.

First, the function of the through hole 2*b* from start of pushing on the switch button 10 to the contact of the conductor 4 and the first electrode 6 will be explained. FIG. 4 illustrates a chart illustrating a relation between the amount of the push on the switch button and the repulsive force (operational feeling of the user). In FIG. 4, the switch mechanism 1 of the present invention and the switch mechanism 401 without a through hole illustrated in FIG. 33 are compared. When the switch buttons 10, 410 of the switch mechanisms 1, 401 are gradually pushed, the central parts of the conductors 4, 404 of the dish shape are pushed by the projecting portions 2*a*, 402*a* and start to deforms to be protruded. With changing the shapes of the conductors 4, 404, the repulsive forces increase and, in the switch mechanism 1 of the present invention, the region where the through hole 2*b* is formed is bent by receiving the repulsive force. Then the repulsive forces of the conductors 4, 404 reach the maximum values (points P1). After this, the repulsive forces of the conductors 4, 404 decrease as the switch buttons proceed pushing. Along therewith, in the switch mechanism 1 of the present invention, the bent region where the through hole 2*b* is formed starts to be restored. When the switch buttons 10, 410 are further pushed, the central parts of the conductors 4, 404 are brought into contact with the first electrodes 6, 406, and the conductors 4, 404 makes the electrical connection between the first electrodes 6, 406 and the second electrodes 7, 407 (points P2). Then the conductors 4, 404 become impossible to change their shapes, and the repulsive forces start to increase by the rigidities of the support boards 2, 402 and others again.

The user senses the operational feelings of the switch buttons 4, 410 by the changes of the repulsive forces from point (s) P1 to point(s) P2. In the switch mechanism 1 of the present invention, from the start of the push to the maximum repulsive force position (point P1), the region where the through hole 2*b* is formed bends as the repulsive force of the conductor 4 increases, and the projecting portion 2*a* is displaced in the pushing direction. Beyond the maximum repulsive force position (point P1), the bending in the region where through hole 2*b* is formed is restored as the repulsive force of the conductor 4 decreases, and the projecting portion 2*a* starts to be restored to the original position. Therefore, from point P1 to point P2, the switch mechanism 1 of the present invention has a greater change in the repulsive force relative to the change of the amount of push than the switch mechanism 401 having no through hole illustrated in FIG. 33 (in FIG. 4, the graph has a steeper grade). By the change of the repulsive force, the user of the switch mechanism 1 of the present invention can sense the clearer operational feeling than the operation of the switch mechanism 401 illustrated in FIG. 33, even if the movable stroke of the conductor 4 is short.

Next, the function of the through hole 2*b* after the conductor 4 contacts with the first electrode 6 will be explained. When the central part of the conductor 4 comes into contact with the first electrode 6, the pushing force of the switch button 10 is applied to the projecting portion 2*a*. The pushing force bends the region where the through hole 2*b* is formed, and displaces the projecting portion 2*a* downward by an extent as much as the region where the through hole 2*b* is formed bends. That is, the height of the projecting portion 2*a* in the surface of the support board 2 decreases. Since this relieves the deformation of the switch button 10 in accordance with the projecting portion 2*a*, the stress generated in the central part of the switch button 10 decreases and the life of the switch button can be prolonged. On the other hand, in the switch mechanism 401 without a through hole illustrated in FIG. 33, since the projecting portion 402 is not displaced downward, the angle of the mountain shape of the switch button 410 in accordance with the projecting portion 402*a* becomes narrower than that of the switch mechanism of the present invention. That is, the stress generated in the central part of the switch button 410 becomes greater. Therefore, if the push on the switch button 410 is repeated, the switch button 410 in the switch mechanism 401 illustrated in FIG. 33 is damaged by fatigue more easily than the switch button 10 in the switch mechanism 1 of the present invention.

According to the switch mechanism of the present invention, by changing the position of the projecting portion upon pushing the switch button, the clear operational feeling can be given to the user, and the life of the switch button can be prolonged. The illumination sheet can be provided between the switch button and the circuit board, and the structure and assembling thereof can be made simple.

The shape, size (area, length, width), number and arrange mode of the through hole may have any mode as far as the support board can be bent at the time of pushing of the switch button 10, and can be suitably designed such that the extent of the bend of the through hole region and the extent of the descent of the projecting portion comfort to a desired extent. FIGS. 5-8 illustrate partial and schematic cross-sectional views of the support boards illustrating examples of the through hole.

Figure 5:
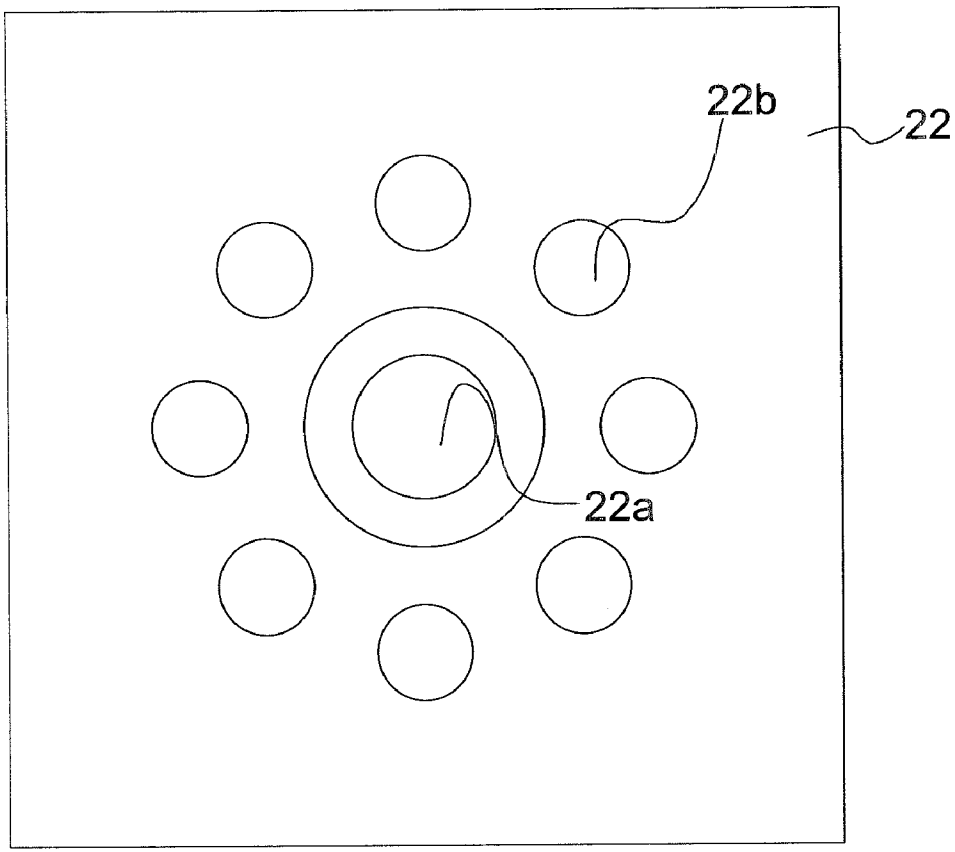
FIG. 5 is a partial and schematic cross-sectional view of a support board according to another mode.

In a support board 22 illustrated in FIG. 5, a plurality of circular through holes 22*b* are arranged around a projecting portion 22*a* at regular intervals, and are formed in a dotted ring-line shape concentric with the center of the projecting portion 22*a*. The shape of each through hole 22*b* is not limited to the circular shape, and various shapes such as an ellipse, polygon and the like can be selected. The size of each through hole 22*b* is unnecessary to be even. The arrangement of the through holes 22*b* is unnecessary to be at regular intervals.

Figure 6:
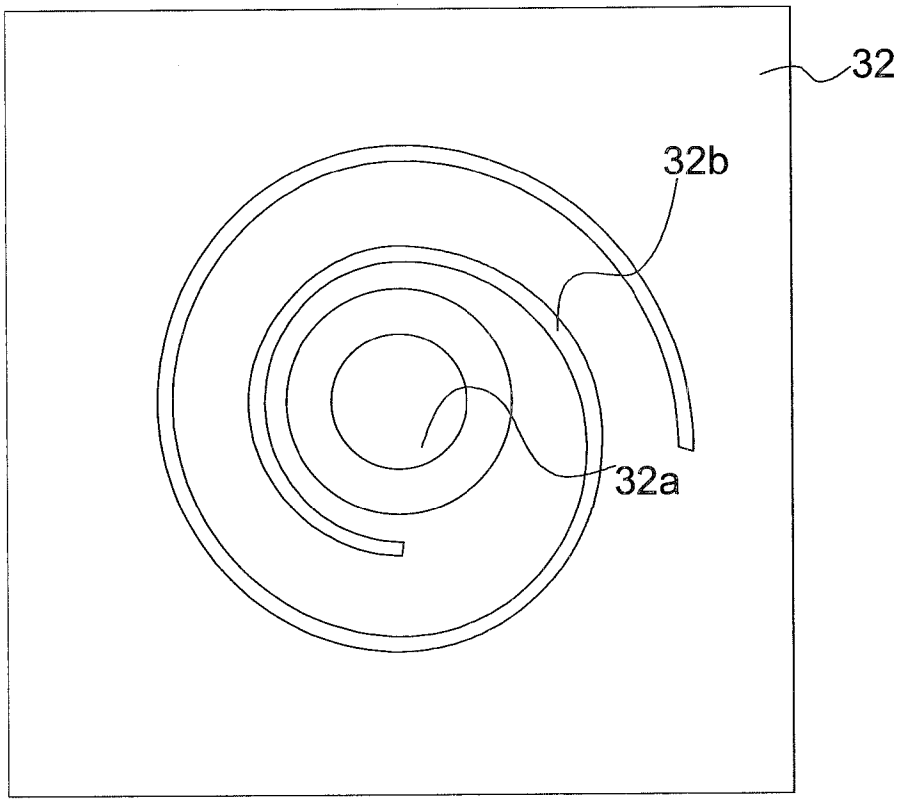
FIG. 6 is a partial and schematic cross-sectional view of a support board according to another mode.

In a support board 32 illustrated in FIG. 6, a through hole 32*b* of a spiral shape is formed such that it swirls around a projecting portion 32*a*. The number of the through hole of the spiral shape is not limited to single, and may be plural.

Figure 7:
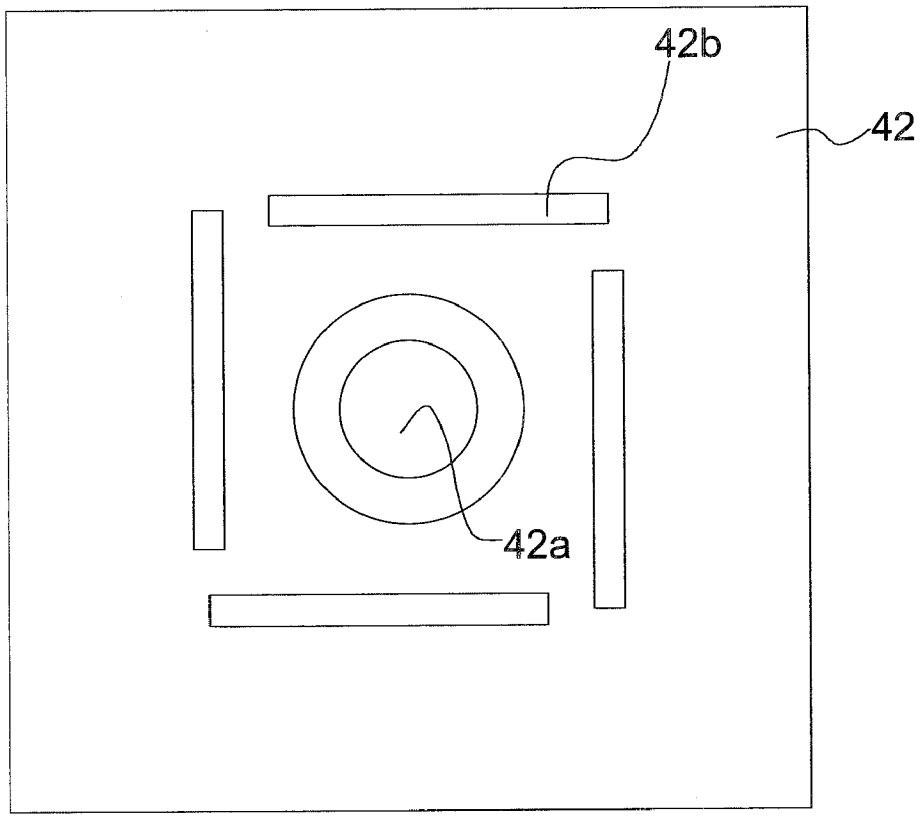
FIG. 7 is a partial and schematic cross-sectional view of a support board according to another mode.

In a support board 42 illustrated in FIG. 7, a plurality of through holes 42*b* of a linear shape (a slit shape) are formed around a projecting portion 42*a* at predetermined intervals such that the plurality of the through holes 42*b* form a rectangle as surrounding the projecting portion 42*a* as a whole. The shape of each through hole 42*b* and the shape which the plurality of the through holes 42*b* form as a whole are not limited to the mode illustrated in FIG. 7, and various modes may be selected. Each through hole may has a curved line shape or wavy line shape, for example. The shape that the plurality of the through holes form may be a polygon, circle, ellipse and the like other than the rectangle.

Figure 8:
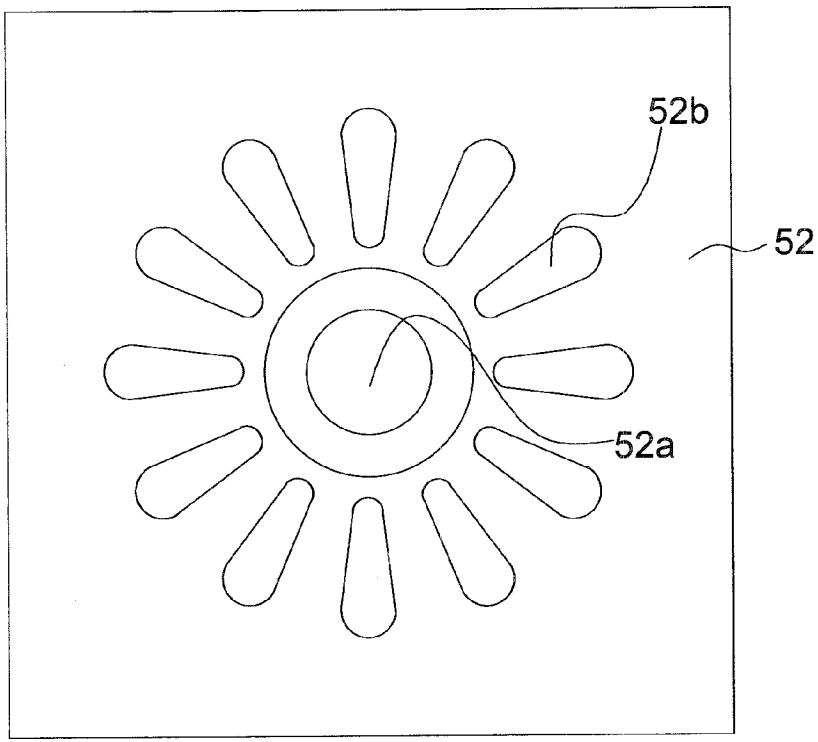
FIG. 8 is a partial and schematic cross-sectional view of a support board according to another mode.

In a support board 52 illustrated in FIG. 8, a plurality of through holes 52*b* of a petallike shape are formed in a radial manner with the center of a projecting portion 52*a* at regular intervals. The shape of each through hole is not limited to the petallike shape, and various shapes such as an ellipse, rectangle and the like can be selected. The arrangement of the through holes is unnecessary to be at regular intervals.

A method of forming the through hole may be a chemical way such as etching or a physical way such as mechanical processing.

Figure 9:
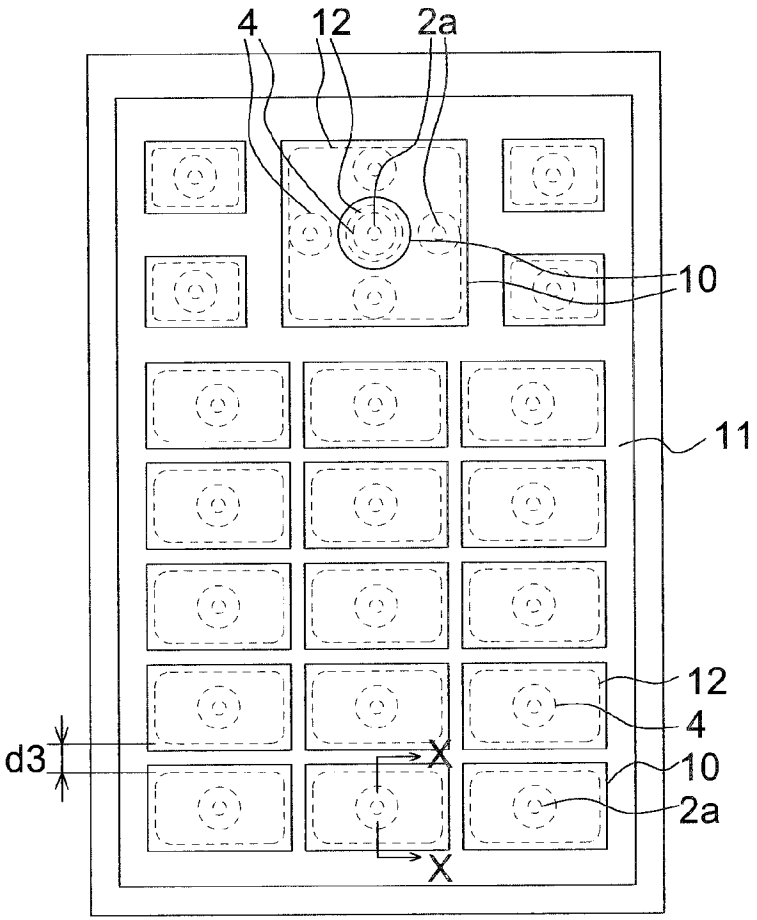
FIG. 9 is a partial and schematic cross-sectional view of a switch mechanism according to a second exemplary embodiment of the present invention.
Figure 10:
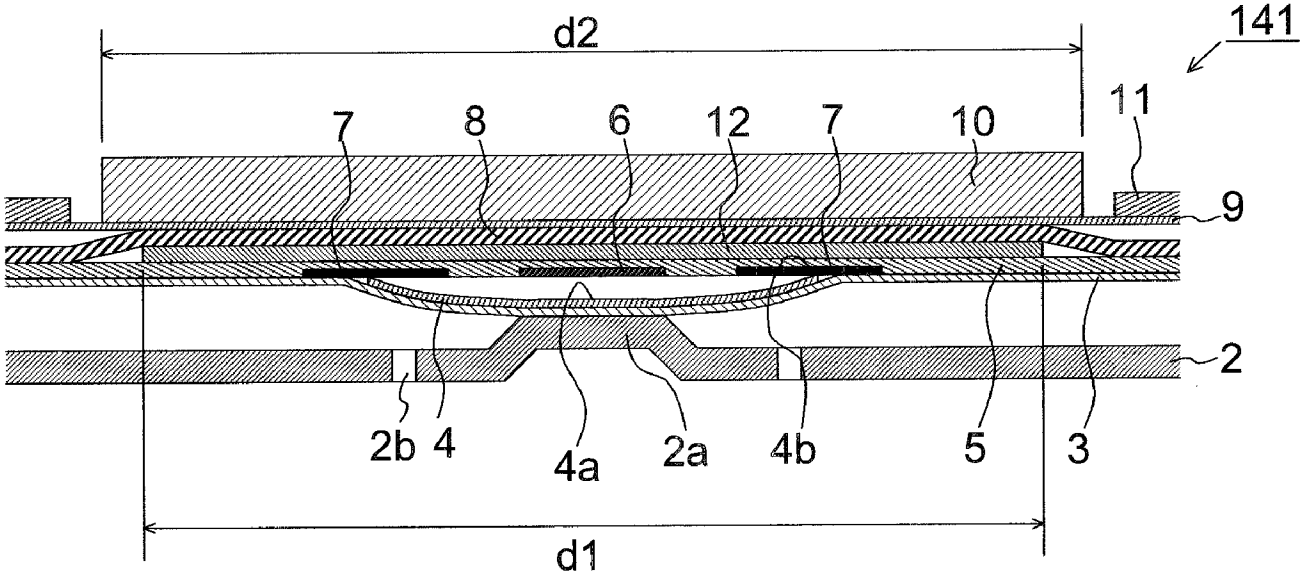
FIG. 10 is a schematic cross-sectional view along an X-X line in FIG. 9.

Next, a switch mechanism according to a second exemplary embodiment of the present invention will be explained. FIG. 9 illustrates a schematic plan view of the switch mechanism according to the second exemplary embodiment of the present invention. FIG. 9 is the partial and schematic cross-sectional view of a mobile phone that is an example of the electronic device of the present invention, and illustrates an example that the switch mechanism of the present invention is applied to an operation part of the mobile phone. In FIG. 9, dotted lines indicate perspective parts. FIG. 10 is a schematic cross-sectional view along an X-X line in FIG. 9 and a schematic cross-sectional view of one switch mechanism. In FIGS. 9 and 10, the same symbols are given to the same elements as the first exemplary embodiment.

In the second exemplary embodiment, a point different from the first exemplary embodiment is that the switch mechanism 141 further has a reinforcing member 12. The reinforcing member 12 is provided in each switch button 10 and joined under the illumination sheet 8 through an adhesive layer (not shown) in order to restrain the switch button 10 from warping excessively in accordance with the shape of the projecting portion 2*a* of the support board 2 when the switch button 10 is pushed. The modes other than reinforcing member 12 are the same as the switch mechanism according to the first exemplary embodiment.

It is preferred that the size (area) and rigidity of the reinforcing member 12 is designed so as to restrain the switch button 10 from warping when the switch button 10 is pushed. The rigidity of the reinforcing member 12 is preferably higher than that of the switch button 10. If the switch button 10 is acrylic resin having a thickness of 0.3 mm, for example, a plate metal of stainless steel having a thickness of 0.1 mm may be applied to the reinforcing member 12. The corner or edge angle of the reinforcing member 12 is preferably chamfered in order not to damage the circuit board 5 and illumination sheet 8. The corner or edge angle may be rounded off by chemical processing, for example. In the projection of the push operation surface of the switch button 10 as illustrated in FIG. 9, the reinforcing member 12 is preferably not protruded from the switch button 10, and the size (area) of the reinforcing member 12 is preferably less than that of the switch button 10, and more preferably covered with the switch button 10 (overlapped with the switch button 10 wholly). In the projection of the push operation surface of the switch button 10, the outer edge of the reinforcing member 12 preferably lies inside the outer edge of the switch button 10. That is, in the cross-section as illustrated in FIG. 10, a cross sectional dimension d1 of the reinforcing member 12 is equal to or smaller than a cross sectional dimension d2 of the switch button 10.

If the rigidity of the reinforcing member 12 is compared with that of the circuit board 5 or switch button 10, Young's modulus is preferably used for the comparison.

The size (area) and rigidity of the reinforcing member 12 are preferably designed such that the user senses good push feeling. In the projection of the push operation surface of the switch button 10 as illustrated in FIG. 9, if the size of the reinforcing member 12 is too small to that of the switch button 10, and the user locally pushes a region where the reinforcing member 12 does not overlap with the switch button 10 with a nail and the like, the switch button 10 is locally bent, the power is not conducted to the conductor 4, and the user can not sense the good push feeling. Accordingly, it is preferred that the reinforcing member 12 has an enough size not to locally deform of the switch button 10 even if the end part of the switch button 10 is locally pushed.

The distance between two adjacent reinforcing members 12 is preferably equal to or greater than 1.0 mm. If a distance d3 in FIG. 9 is less than 1.0 mm, the bend of the illumination sheet 8, circuit board 5 and others between the adjacent switch buttons 10 is suppressed, bringing about an interior user's click feeling. In the projection of the push operation surface of the switch button 10 as illustrated in FIG. 9, if the switch button 10 has a plan outer shape of 10 mm×6 mm, and a distance between two adjacent switch buttons 10 is 0.5 mm, for example, it is preferred that the reinforcing member 12 has a plan outer shape equal to or less than 9.5 mm×5.5 mm and that the reinforcing members 12 are arranged so as to have a regular distance between the outer edge of the switch button 10 and the outer edge of the reinforcing member 12.

The reinforcing member 12 may have any shape as far as the switch button 10 can be restrained from warping and may be formed of a flat plate member, for example. The reinforcing member 12 may be formed of a member having at least one through hole such as a reticulate member or frame member. The plan outer shape of the reinforcing member 12 is not limited to a rectangle, and various modes such as a circle, ellipse, polygon and the like may be adopted in accordance with the shape of the switch button 10.

The circuit board 5 is provided under the illumination sheet 8 and reinforcing member 12. The shape of the circuit board 5 is preferably possible to partially change in accordance with the movement of the switch button 10 when the switch button 10 is pushed, and the circuit board is preferably formed as a flexible printed circuit (FPC). In the circuit board 5, the first electrode 6 and the second electrode 7 of a ring form surrounding the first electrode 6 are formed every switch button 10. A pair of the first electrode 6 and second electrode 7 is disposed under the switch button 10 and reinforcing member 12.

In this exemplary embodiment, the reinforcing member 12 is provided between the illumination sheet 8 and the circuit board 5, however, if the reinforcing member 12 has at least one through hole, since the switch button 10 can be illuminated through the through hole, the reinforcing member 12 may be provided between the switch button 10 and the illumination sheet 8.

The circuit board 5 and illumination sheet 8 are pressed and stuck so as to close a gap between the adjacent reinforcing members 12. In FIG. 10, the shape of the illumination sheet 8 is changed in accordance with the reinforcing member 12. An electrode (not shown) of the illumination sheet 8 and terminal (not shown) of the circuit board 5 are electrically connected with each other through anisotropic conductive paste (ACP) (not shown), for example. If the illumination sheet 8 is formed of an inorganic EL sheet, the inorganic EL sheet has a characteristic that acoustic noise that is peculiar to alternating current driving is generated and, however, according to the present invention, the weight of the inorganic EL sheet is increased by sticking the reinforcing member 12 to the inorganic EL sheet, and the acoustic noise can be reduced.

Figure 11:
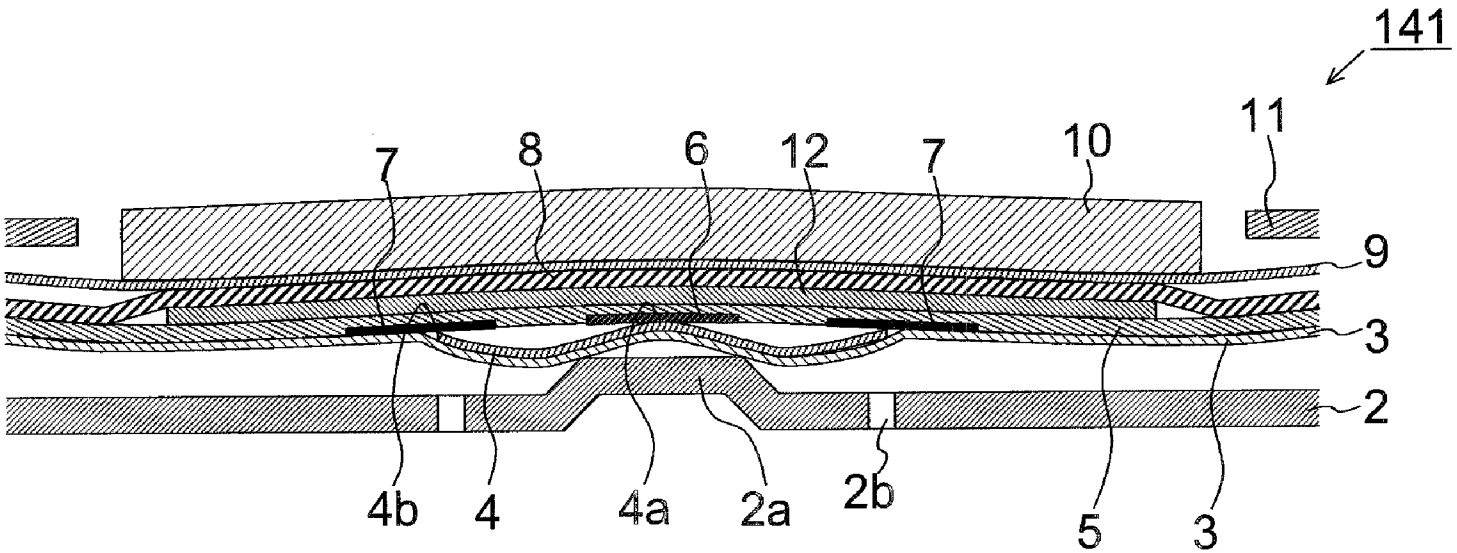
FIG. 11 is a partial and schematic cross-sectional view illustrating a state of a pushed switch button in a switch mechanism according to a second exemplary embodiment of the present invention.

FIG. 11 illustrates a partial and schematic cross-sectional view illustrating the state of the pushed switch button in the switch mechanism according to the second exemplary embodiment of the present invention. In this exemplary embodiment, when the switch button 10 is pushed, the reinforcing member 12 restrains the switch button 10 from warping excessively in accordance with the shape of the projecting portion 2*a*. That is, the extent of the deformation of the switch button 10 is reduced than the switch mechanism without a reinforcing member as illustrated in FIG. 1. This can reduce the stress exerted to the switch button 10 at the time of pushing the switch button 10 and can prevent the switch button 10 from being damaged by fatigue because of repeat of pushing on the switch button 10. Therefore, according to the switch mechanism 141 of the present invention, the life of the switch mechanism 141 is prolonged and endurance reliability can be improved.

Figure 12:
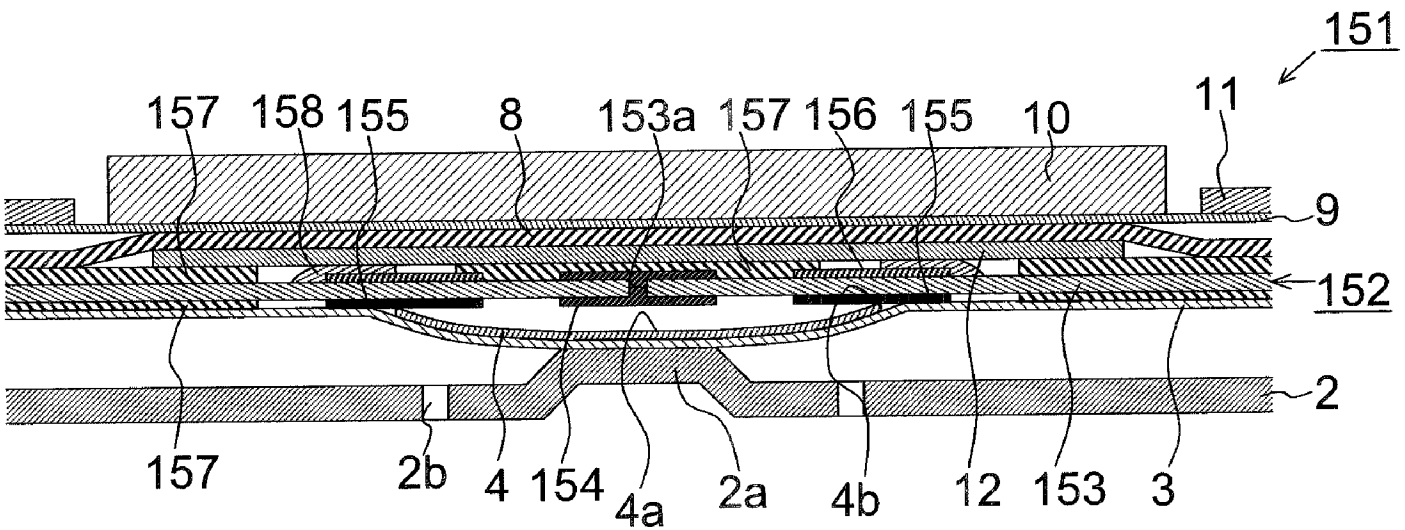
FIG. 12 is a partial and schematic cross-sectional view of a switch mechanism according to a first mode of a third exemplary embodiment of the present invention.

A switch mechanism according to a third exemplary embodiment of the present invention will be explained. First, a first mode of the third exemplary embodiment will be explained. FIG. 12 illustrates a partial and schematic cross-sectional view of the switch mechanism according to the first mode of the third exemplary embodiment of the present invention. In FIG. 12, the same symbols are given to the same elements as the first exemplary embodiment and second exemplary embodiment.

In a switch mechanism 151 according to this exemplary embodiment, a reinforcing member 12 is electrically connected to a ground potential wiring of a circuit board 152. Generation of an ESD (Electrostatic Discharge) is prevented by electrically connecting the reinforcing member 12 that is in an electrically floating state with the ground, and the reliability of the device can be improved. The modes other than the reinforcing member 12, circuit board 152 and electrical connection between the circuit board 152 and the reinforcing member 12 in the switch mechanism 151 are the same as the switch mechanisms according to the first exemplary embodiment and second exemplary embodiment.

Figure 13:
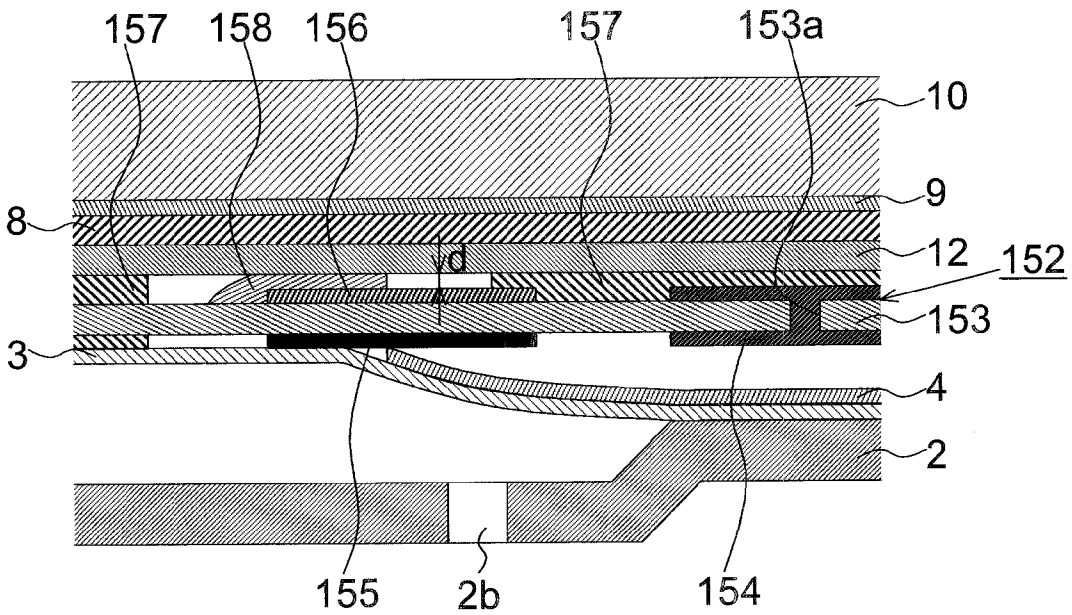
FIG. 13 is a partial and schematic cross-sectional view to explain electrical connection between a reinforcing member and a circuit board.

FIG. 13 illustrates a partial and schematic cross-sectional view to explain electrical connection between the reinforcing member 12 and the circuit board 152. The circuit board 152 comprises a substrate 153 that has an insulating sheet such as polyimide, wiring (not shown) formed in the insulating sheet and electrodes such as a first electrode 154, second electrode 155, ground electrode 156 and the like, and an insulating layer 157 that covers at least a part of the substrate 153. The first electrode 154 and second electrode 155 are electrodes that are electrically connected to the conductor 4 when the switch button 10 is pushed, likewise the first exemplary embodiment. The first electrode 154 is electrically connected to the wiring formed on a surface of the opposite side through a through hole 153*a* formed in the insulating sheet.

The insulating layer 157 covers the wiring that needs insulation and may be formed of epoxy resin and polyimide resin, for example.

The ground electrode 156 is electrically connected to the ground potential wiring (not shown). In this exemplary embodiment, the reinforcing member 12 is formed of a conductive material, and the ground electrode 156 and the reinforcing member 12 are electrically connected with each other. The ground electrode 156 is preferably formed on a surface facing to the reinforcing member 12 so as to face to the reinforcing member 12. The ground electrode 156 may be formed in a position electrically connectable to the reinforcing member 12, and in the mode illustrated in FIGS. 12 and 13, is formed on the back side of the second electrode 155, for example.

A mode of the electrical connection between the ground electrode 156 and the reinforcing member 12 is not limited and may suitably adopt various modes. The ground electrode 156 and the reinforcing member 12 may be in direct contact with each other or may be electrically connected through a conductive adhesive 158 as illustrated in FIGS. 12 and 13, for example. When the wiring (not shown) is covered with the insulating layer 157, the height of the insulating layer 157 from the insulating sheet becomes higher than that of the ground electrode 156. Since this causes a gap d (0.01 mm to 0.02 mm, for example) between the ground electrode 156 and the reinforcing member 12, the conductive adhesive 158 is preferably used.

Figure 14:
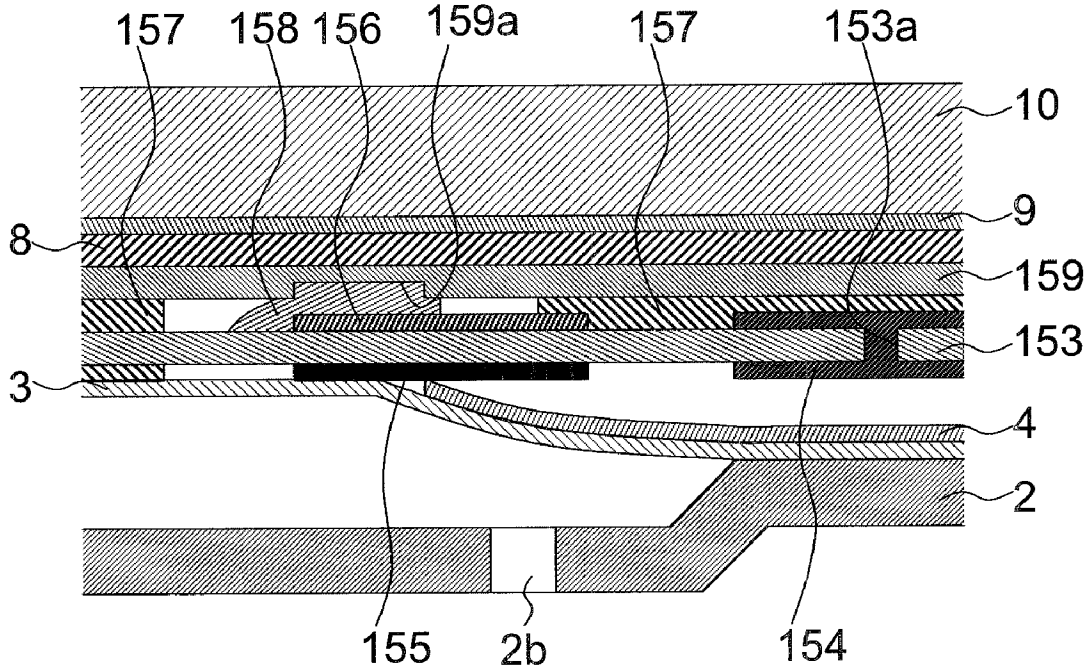
FIG. 14 is a partial and schematic cross-sectional view to explain electrical connection between a reinforcing member and a circuit board.

FIG. 14 illustrates a partial and schematic cross-sectional view of a different mode from the mode illustrated in FIG. 13. In the mode illustrated in FIG. 14, a reinforcing member 159 has a concave portion 159*a* on at least a part of a surface facing to a ground electrode 156. The concave portion 159*a* functions as puddle of an adhesive. If it is difficult to control the amount of the applied conductive adhesive 158, the concave portion 159*a* can prevent the conductive adhesive 158 from flowing out to an unnecessary part.

Figure 15:
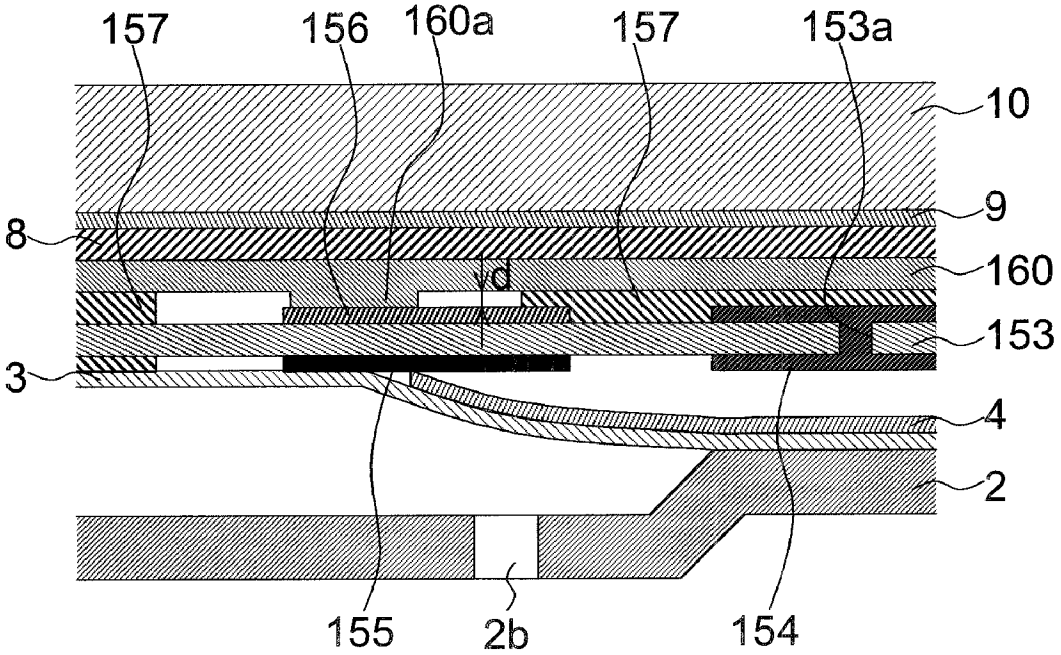
FIG. 15 is a partial and schematic cross-sectional view to explain electrical connection between a reinforcing member and a circuit board.

FIG. 15 illustrates a partial and schematic cross-sectional view of a different mode from the modes illustrated in FIGS. 13 and 14. In the modes illustrated in FIGS. 13 and 14, the conductive adhesive 158 is used to fill the gap d between the ground electrode 156 and the reinforcing members 12, 159, whereas, in a mode illustrated in FIG. 15, no conductive adhesive is used. In the mode illustrated in FIG. 15, a reinforcing member 160 has a convex portion 160*a* in at least a part facing to the ground electrode 156. The reinforcing member 160 is in contact with the ground electrode 156 at the convex portion 160*a* to make an electrical connection. The height of the convex portion 160*a* is preferably equal to the gap d between the ground electrode 156 and the reinforcing member 160, or may be adjusted to the gap d by pressing the reinforcing member 160 and the ground electrode 156. The convex portion 160*a* may be formed by etching processing, press processing and the like.

According to the first mode of the third exemplary embodiment, the generation of the ESD can be prevented, and the reliability of an electronic device using the switch mechanism of the present invention can be improved. In particular, it is preferred that this exemplary embodiment is applied to a case where the metallic reinforcing member is in an electrically floating state (an independent state without electrically connecting with anything) or a case where the electric charge is accumulated in the reinforcing member and there is a probability that the ESD causes malfunction and trouble of the electronic device.

Figure 16:
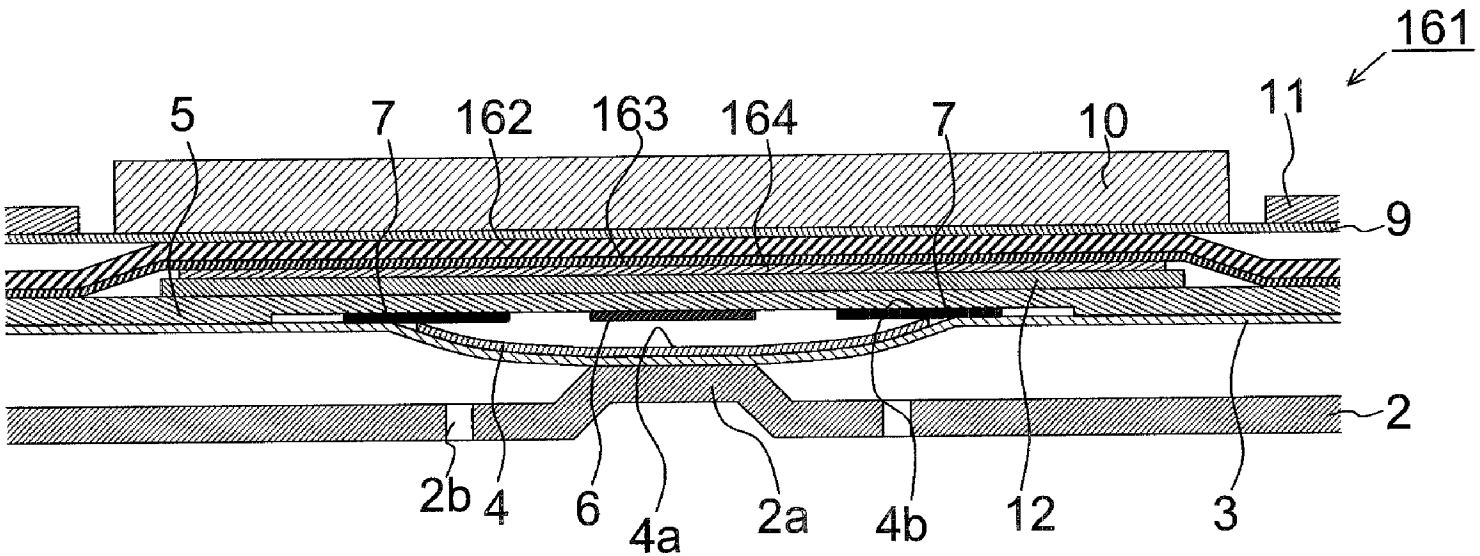
FIG. 16 is a partial and schematic cross-sectional view of a switch mechanism according to a second mode of a third exemplary embodiment of the present invention.

Next, a switch mechanism according to a second mode of the third exemplary embodiment of the present invention will be explained. FIG. 16 illustrates a partial and schematic cross-sectional view of the switch mechanism according to the second mode of the third exemplary embodiment of the present invention. In FIG. 16, the same symbols are given to the same elements as the first mode.

In a switch mechanism 161 according to the second mode of the third exemplary embodiment, a reinforcing member 12 is electrically connected with a ground potential wiring 163 of an illumination sheet 162. By electrically connecting the reinforcing member 12 that is in an electrically floating state with the ground, the generation of the ESD can be prevented, the reliability of the electronic device can be improved. The modes other than the reinforcing member 12, illumination sheet 162 and electrical connection between the illumination sheet 162 and the reinforcing member 12 in the switch mechanism 161 are similar to the switch mechanisms according to the first exemplary embodiment and second exemplary embodiment.

Figure 17:
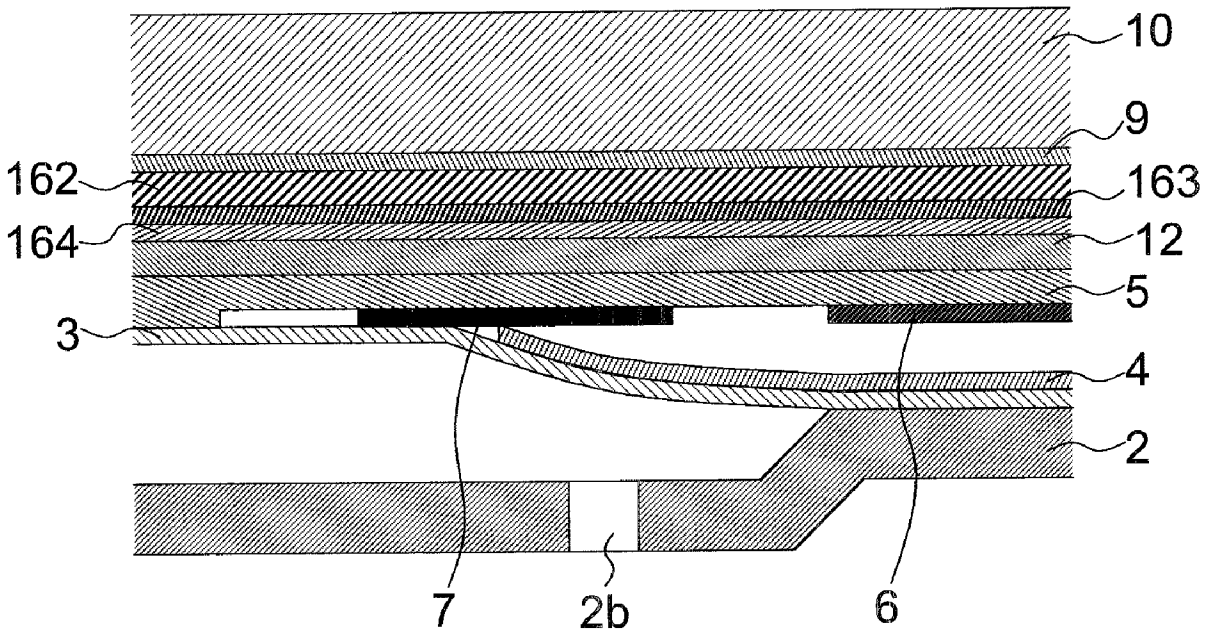
FIG. 17 is a partial and schematic cross-sectional view to explain electrical connection between a reinforcing member and an illumination sheet.

FIG. 17 illustrates a partial and schematic cross-sectional view to explain electrical connection between the reinforcing member 12 and the illumination sheet 162. The illumination sheet 162 has the ground potential wiring 163 that faces at least a part of the reinforcing member 12 on a surface facing to the reinforcing member 12. In the mode illustrated in FIGS. 16 and 17, the reinforcing member 12 is provided between the illumination sheet 162 and the circuit board 5. The ground potential wiring 163 may be formed by printing a pattern of Ag paste on a non-illuminating surface of the illuminating sheet 162, for example.

In the second mode of the third exemplary embodiment, the reinforcing member 12 is formed of a conductive material and electrically connected with the ground potential wiring 163. A mode of the electrical connection between the ground potential wiring 163 and the reinforcing member 12 is not limited, and various modes may be suitably applied. For example, the ground potential wiring 163 and the reinforcing member 12 may be in direct contact with each other, or may be electrically connected through a conductive adhesive 164 as illustrated in FIGS. 16 and 17.

Figure 18:
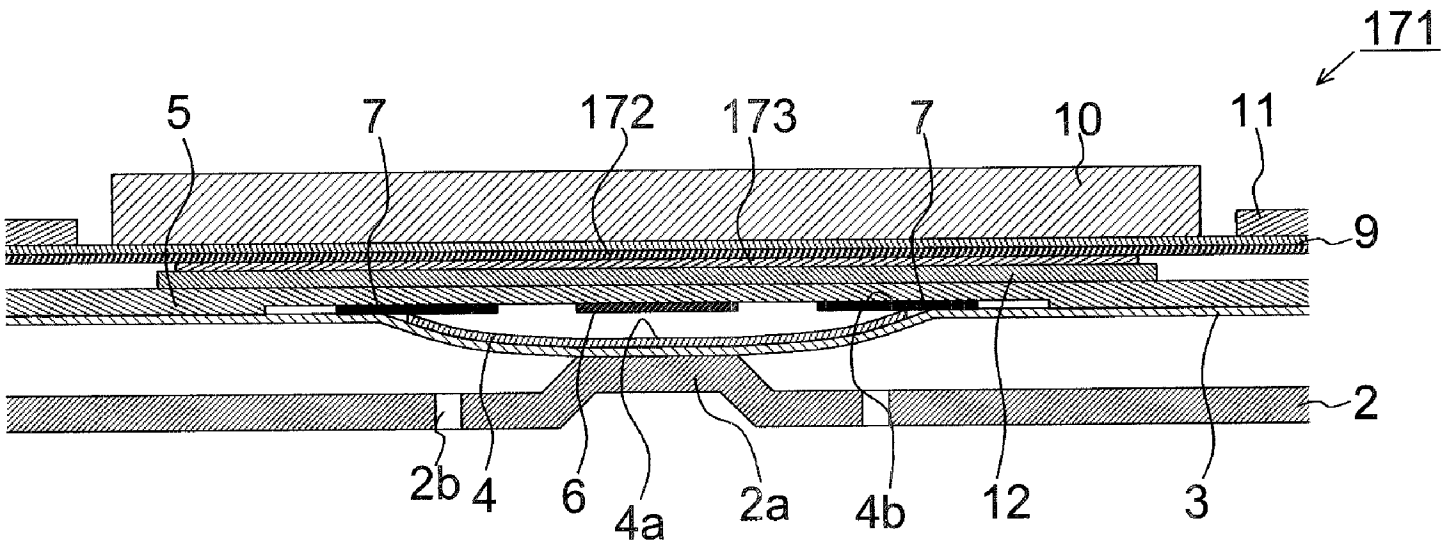
FIG. 18 is a partial and schematic cross-sectional view of a switch mechanism according to a third mode of a third exemplary embodiment of the present invention.

Next, a switch mechanism according to a third mode of the third exemplary embodiment of the present invention will be explained. FIG. 18 illustrates a partial and schematic cross-sectional view of the switch mechanism according to the third mode of the third exemplary embodiment of the present invention. In FIG. 18, the same symbols are given to the same elements as the first exemplary embodiment.

A switch mechanism 171 according to the third mode of the third exemplary embodiment does not have an illumination sheet. The switch mechanism 171 has a ground potential wiring 172 under a thin sheet 9. A reinforcing member 12 is electrically connected with the ground potential wiring 172. This can prevent the generation of the ESD by electrically connecting the reinforcing member 12 that is an electrically floating state with the ground, and the reliability of the electronic device can be improved. The modes other than that there is no illumination sheet, and electrical connection between the reinforcing member 12 and the circuit board 172 are the same as the switch mechanisms according to the first exemplary embodiment and second exemplary embodiment.

The mode of the electrical connection between the ground potential wiring 172 and the reinforcing member 12 is not limited, and various modes may be suitably applied. For example, the ground potential wiring 172 and the reinforcing member 12 may be in direct contact with each other or may be electrically connected through a conductive adhesive 173 as illustrated in FIG. 18.

Figure 19:
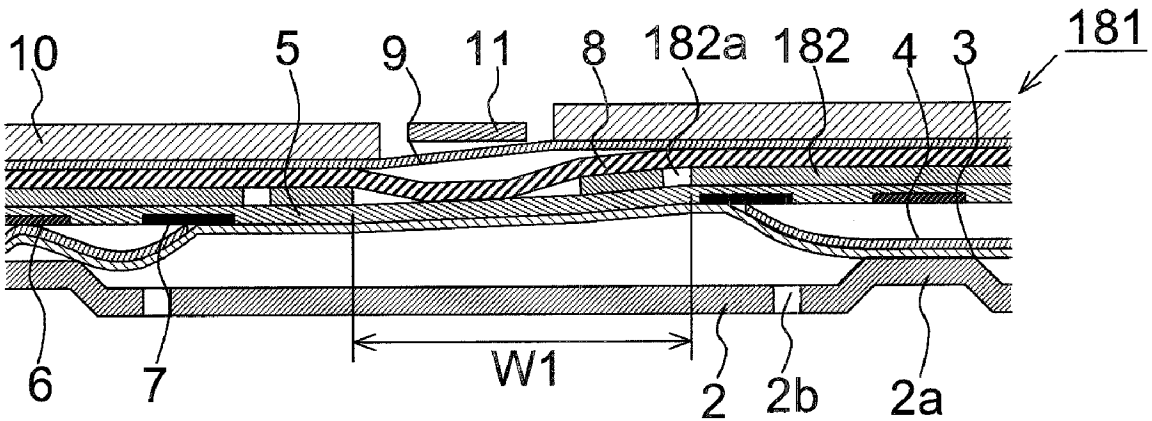
FIG. 19 is a partial and schematic cross-sectional view of a switch mechanism according to a first mode of a fourth exemplary embodiment of the present invention.
Figure 20:
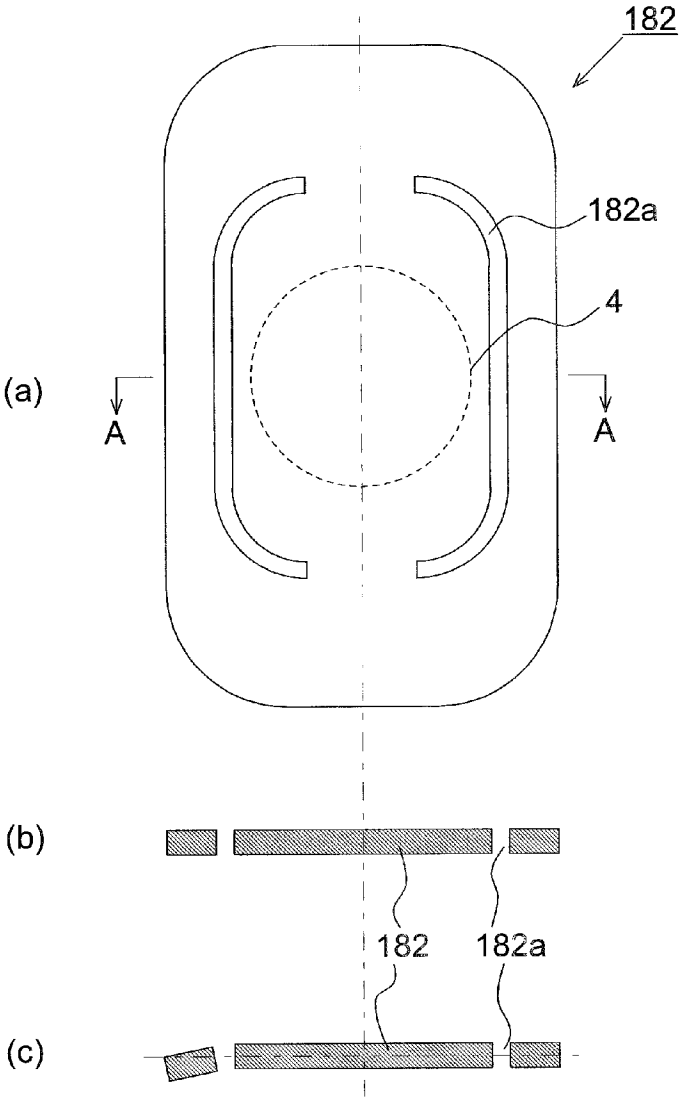
FIG. 20 is a schematic plan view and schematic cross-sectional view of a reinforcing member in a switch mechanism according to a fourth exemplary embodiment of the present invention.

A switch mechanism according to a fourth exemplary embodiment of the present invention will be explained. First, a switch mechanism according to a first mode of the fourth exemplary embodiment will be explained. FIG. 19 illustrates a partial and schematic cross-sectional view of the switch mechanism according to the first mode of the fourth exemplary embodiment of the present invention. FIG. 19 is the schematic cross-section between adjacent reinforcing members when a switch button is pushed. FIG. 20 illustrates a schematic plan view and schematic cross-sectional view of the reinforcing member in the switch mechanism according to the fourth exemplary embodiment of the present invention. (a) of FIG. 20 is the schematic cross-sectional view of the reinforcing member, and (a) and (b) of FIG. 20 are the schematic cross-sectional views along an A-A line of (a) of FIG. 20. In (a) of FIG. 20, a dotted line indicates a projection of a conductor 4. In FIG. 19, the same symbols are given to the same elements as the first exemplary embodiment.

In the switch mechanism 181 according to the fourth exemplary embodiment of the present invention, the modes other than a reinforcing member 182 are the same as the switch mechanisms according to the first exemplary embodiment and second exemplary embodiment. At least one mode in the second exemplary embodiment and third exemplary embodiment may be incorporated into the present mode.

The reinforcing member 182 has at least one deforming supplementary portion 182*a* that makes it easy to bend at least a part of the reinforcing member 182 or makes it easy to deform at the reinforcing member 182 reversibly. In the mode illustrated in FIG. 20, the deforming supplementary portion 182*a* is formed as the through holes of a slit form along a part of the contour of the reinforcing member 182. The deforming supplementary portion 182*a* is formed at such a position that the deforming supplementary portion is not overlapped with the conductor 4 on the projection in order to prevent the conductor 4 from changing its shape excessively.

Figure 21:
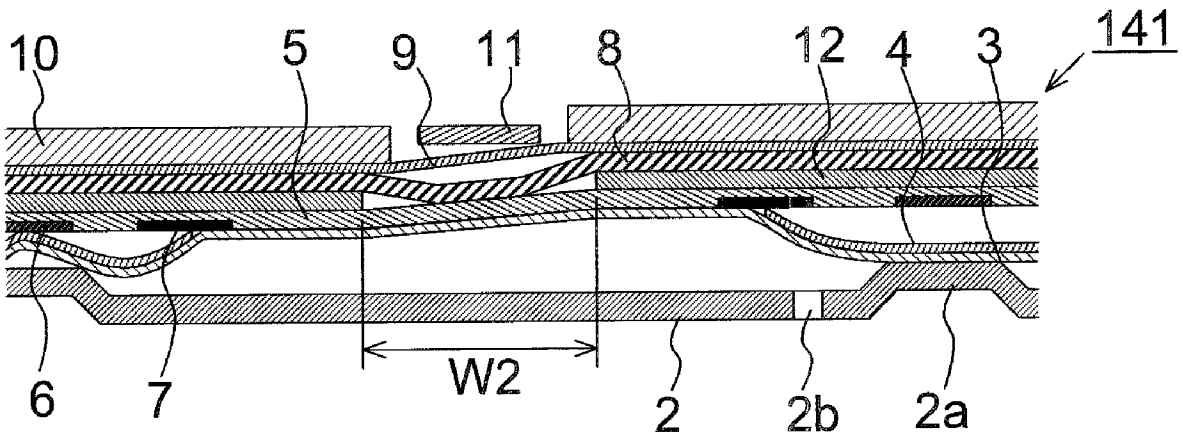
FIG. 21 is a schematic cross-sectional view of a switch mechanism according to a second exemplary embodiment of the present invention.

Next, an action of the deforming supplementary portion 182*a* will be explained. FIG. 21 illustrates the schematic cross-sectional view of the switch mechanism without a deforming supplementary portion according to the third exemplary embodiment of the present invention. FIG. 21 is the schematic cross-section between adjacent switch buttons when the switch button is pushed as same as FIG. 19. In the switch mechanism 181 according to the first mode of the fourth exemplary embodiment, when the switch button 10 (left switch button in FIG. 19) is pushed, the deforming supplementary portion 182*a* partially bends a part or end, which is on the pushed switch button side, of the reinforcing member 182 below the switch button 10 (right switch button in FIG. 19) adjacent to the pushed switch button 10 as illustrated in FIG. 20(*c*). This can widen a region (area) that the circuit board 5, illumination sheet 8 and others bend when the switch button 10 is pushed as compared with a mode without a deforming supplementary portion as illustrated in FIG. 21. That is, in the mode without a deforming supplementary portion as illustrated in FIG. 21, the region where the circuit board 5 and others bend when the switch button is pushed have the width W2 between adjacent reinforcing members 12. On the other hand, the mode according to this exemplary embodiment as illustrated in FIG. 19, a region where the circuit board 5 and others bend when the switch button 10 is pushed has a width W1 between an outer edge of the reinforcing member 182 below the pushed switch button 10 and the deforming supplementary portion 182*a* of the reinforcing member 182 below the adjacent switch button. According to this exemplary embodiment, since the region where the circuit board 5 and others bend is expanded, an interaction between the adjacent switch buttons is made smaller, and a click feeling can be made clearer.

Since a reinforcing member 182 part outside the deforming supplementary portion 182*a* supports the switch button 10, the user can more clearly feel the presence of the switch button 10 (the feeling as a button when the switch button 10 is pushed). For example, the region where the circuit board 5 and others bend can be expanded even if the area of the reinforcing member is reduced. However, since the reinforcing member 182 does not support the outer edge of the switch button 10 and its periphery, the user becomes difficult to sense the presence of the switch button 10. On the other hand, according to this exemplary embodiment, by bringing the outer edge of the reinforcing member 182 closer to the outer edge of the switch button 10, the user can easily sense the presence of the switch button 10.

The mode, shape, size (dimensions) and others of the deforming supplementary portion can be suitably designed as far as the deforming supplementary portion can partially deforms or bend the reinforcing member easily. FIGS. 22-28 illustrate schematic plan views and schematic cross-sectional views illustrating examples of the reinforcing member that has the deforming supplementary portion. In FIGS. 22-26, (a) is a schematic plan view, and (b) is a schematic cross-sectional view along an A-A line of (a).

Figure 22:
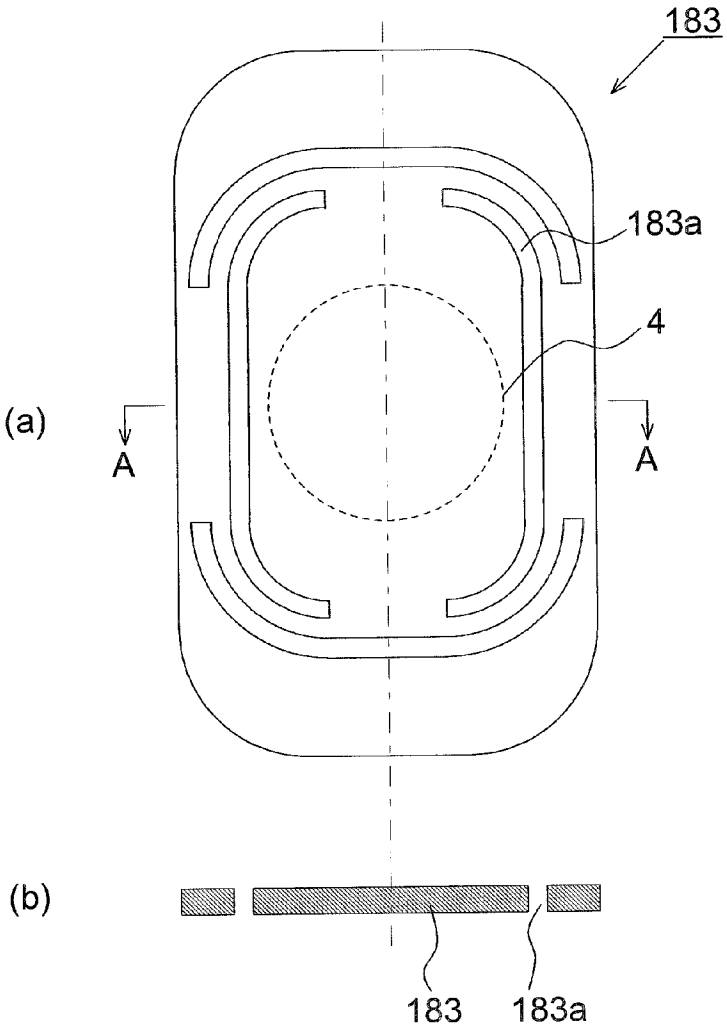
FIG. 22 is a schematic plan view and schematic cross-sectional view illustrating an example of a reinforcing member that has a deforming supplementary portion.

A deforming supplementary portion 183*a* of a reinforcing member 183 illustrated in FIG. 22 is through holes of a slit form that are formed along the four sides of the reinforcing member 183. The through holes are partially formed in dual fashion. This makes it easy to bend the end of each side.

Figure 23:
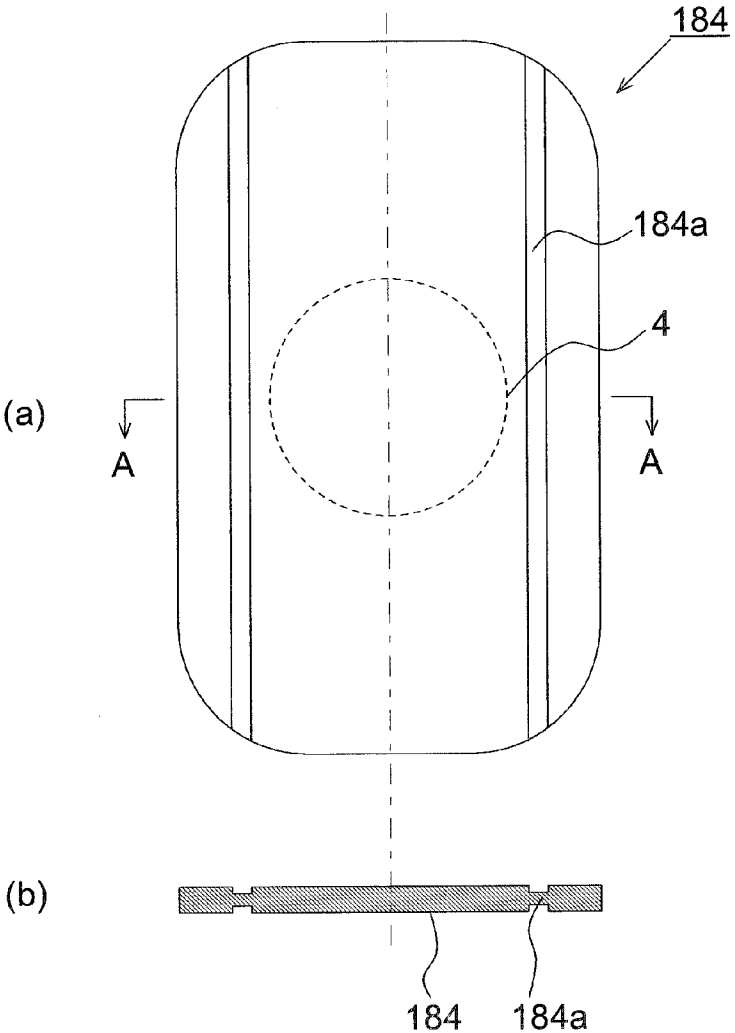
FIG. 23 is a schematic plan view and schematic cross-sectional view illustrating an example of a reinforcing member that has a deforming supplementary portion.

A deforming supplementary portion 184*a* of a reinforcing member 184 illustrated in FIG. 23 is at least one groove formed along the side of the reinforcing member 184. In the mode illustrated in FIG. 23, the groove is formed on both surfaces, and the thickness of the deforming supplementary portion 184*a* is thinner than that of the other part.

Figure 24:
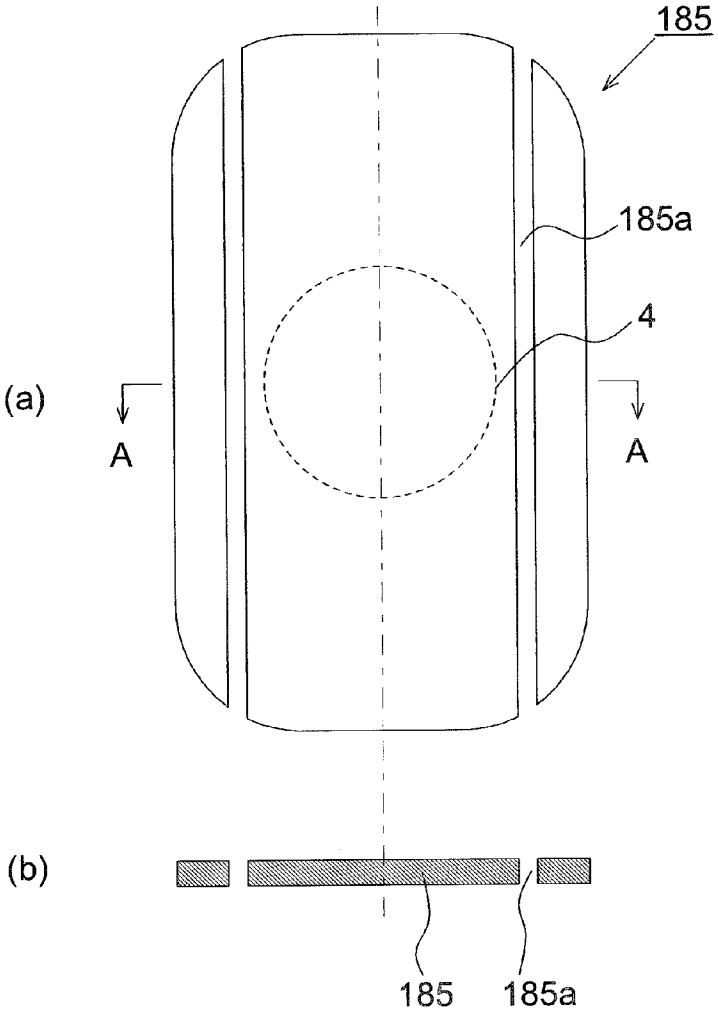
FIG. 24 is a schematic plan view and schematic cross-sectional view illustrating an example of a reinforcing member that has a deforming supplementary portion.

A deforming supplementary portion 185*a* of a reinforcing member 185 illustrated in FIG. 24 is formed as a gap to divide the reinforcing member 185 into pieces. In a mode illustrated in FIG. 24, the reinforcing member 185 is divided into three pieces by two deforming supplementary portions 185*a*.

Figure 25:
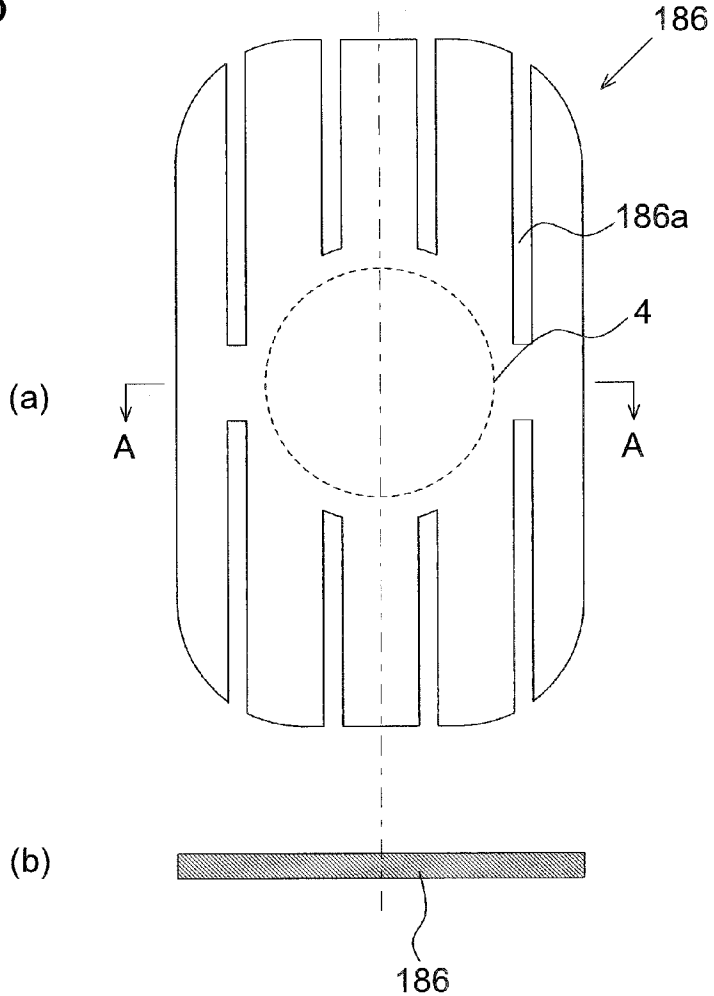
FIG. 25 is a schematic plan view and schematic cross-sectional view illustrating an example of a reinforcing member that has a deforming supplementary portion.
Figure 26:
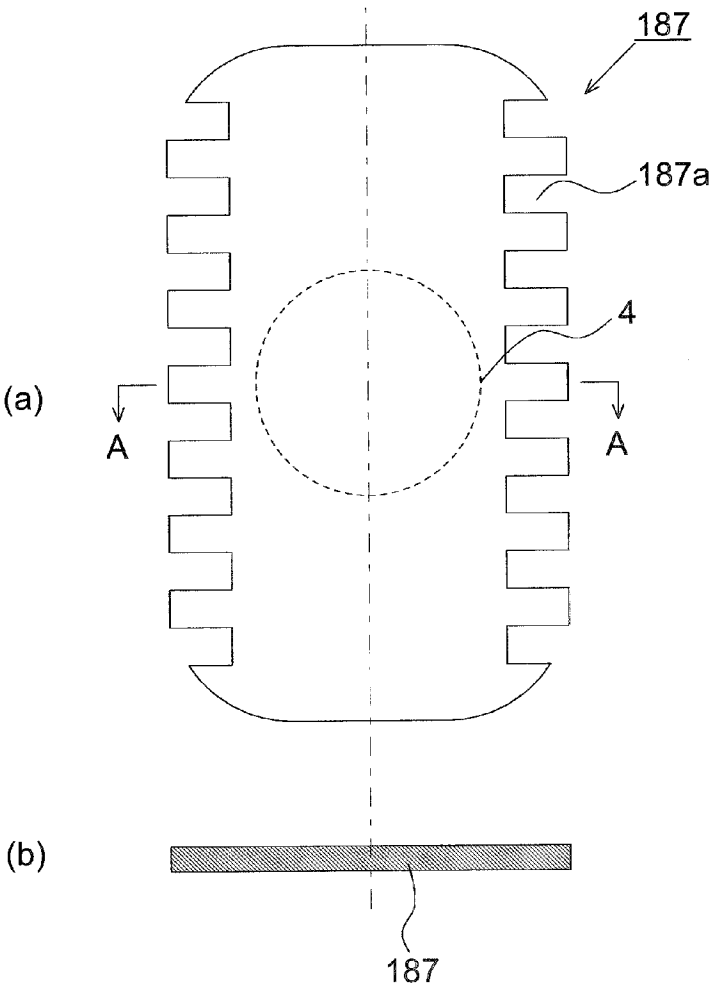
FIG. 26 is a schematic plan view and schematic cross-sectional view illustrating an example of a reinforcing member that has a deforming supplementary portion.

Deforming supplementary portions 186*a*, 187*a* of reinforcing members 186, 187 illustrated in FIGS. 25 and 26 are at least one notch. In the modes illustrated in FIGS. 25 and 26, the notches are formed in opposing two sides, but may be formed in four sides.

Figure 27:
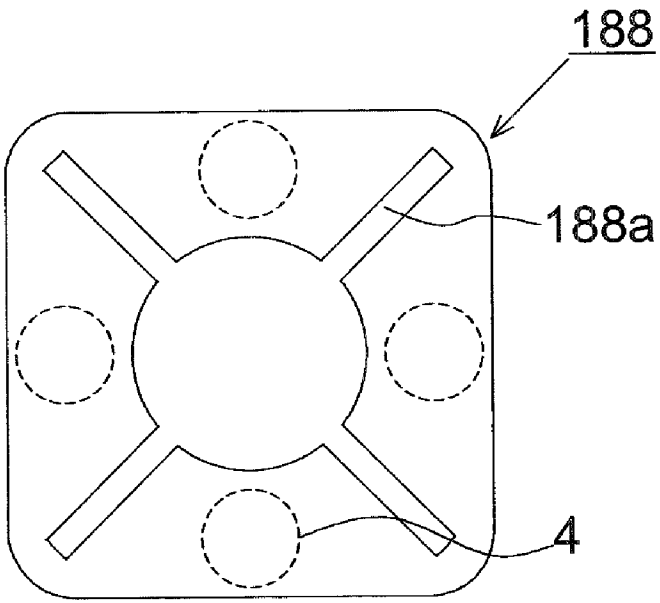
FIG. 27 is a schematic plan view and schematic cross-sectional view illustrating an example of a reinforcing member that has a deforming supplementary portion.
Figure 28:
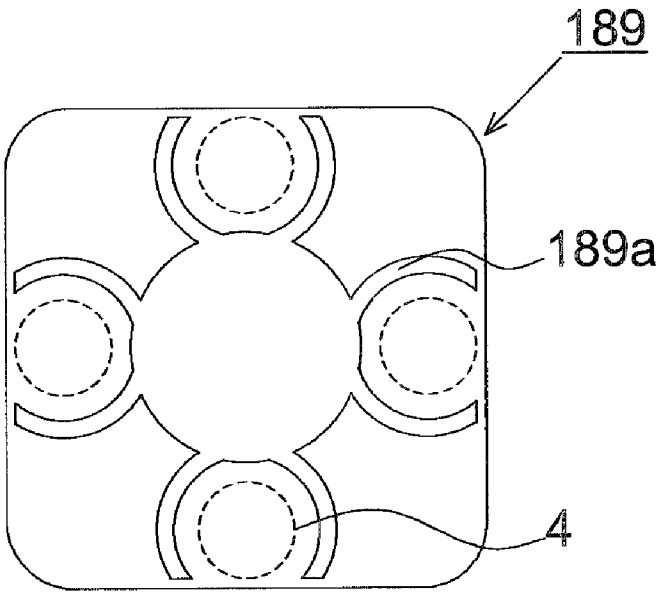
FIG. 28 is a schematic plan view and schematic cross-sectional view illustrating an example of a reinforcing member that has a deforming supplementary portion.

Reinforcing members 188, 189 illustrated in FIGS. 27 and 28 are provided below a switch button of a four-direction (up, down, left and right) key that is used in the mobile phone and the like. The reinforcing members 188, 189 are provided over four (up, down, left and right) conductors 4. Deforming supplementary portions 188*a*, 189*a* are formed between adjacent conductors 4. In the reinforcing member 188 illustrated in FIG. 27, the deforming supplementary portion 188*a* is formed as notches (through holes) of a radial manner (cross manner) extending between adjacent conductors 4. In the reinforcing member 189 illustrated in FIG. 28, the deforming supplementary portion 189*a* is formed as notches (through holes) of a circular arc manner along the contour of the conductor 4.

Figure 29:
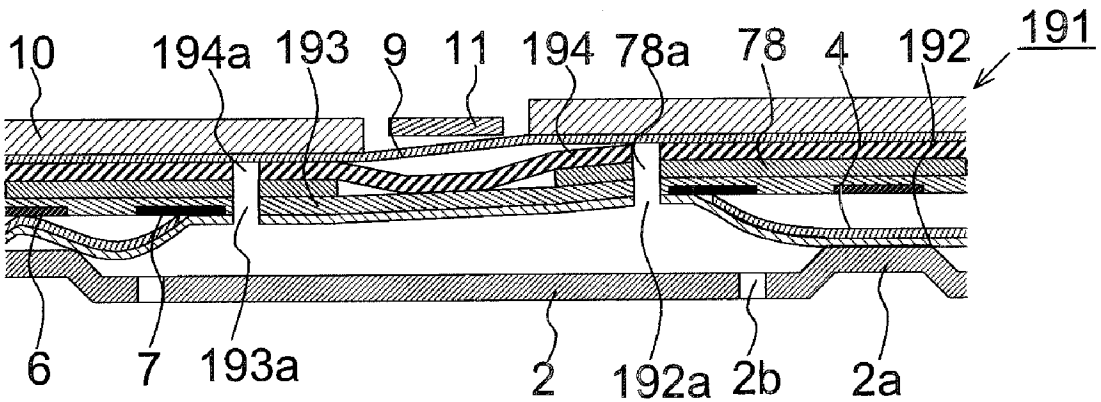
FIG. 29 is a partial and schematic cross-sectional view of a switch mechanism according to a second mode of a fourth exemplary embodiment of the present invention.

A switch mechanism according to a second mode of the fourth exemplary embodiment will be explained. FIG. 29 illustrates a partial and schematic cross-sectional view of the switch mechanism according to the second mode of the fourth exemplary embodiment of the present invention. FIG. 29 is the schematic cross-section between adjacent switch buttons when the switch button is pushed. In the first mode of the fourth exemplary embodiment, the deforming supplementary portion is formed only in the reinforcing member, whereas, in the second mode of the fourth exemplary embodiment, the deforming supplementary portion is formed in other members.

The deforming supplementary portion that make it easy to deform or bend may be formed in at least one of an adhesive sheet 192, a circuit board 193 and an illumination sheet 194. In a mode illustrated in FIG. 29, deforming supplementary portions 192*a*, 193*a*, 194*a* of a through hole type are formed in the adhesive sheet 192, the circuit board 193 and the illumination sheet 194. The deforming supplementary portions 192*a*, 193*a*, 194*a* may be of the thin type. At least parts of the deforming supplementary portions in the members are preferably disposed so as to be overlapped with each other. In the mode illustrated in FIG. 29, for example, the deforming supplementary portion 194*a* of the illumination sheet 194, the deforming supplementary portion 78*a* of the reinforcing member 78, the deforming supplementary portion 193*a* of the circuit board 193, and the deforming supplementary portion 192*a* of the adhesive sheet 192 are disposed so as to be overlapped with one another, that is, to successively communicate the through holes. Therefore, the circuit board 193 and others are made it easier to be bent when the switch button 10 is pushed.

In the switch mechanism according to the second mode of the fourth exemplary embodiment, the modes other than the circuit board and others are similar to the switch mechanisms according to the first mode of the fourth exemplary embodiment. At least one mode in the second exemplary embodiment and third exemplary embodiment may be incorporated into the present mode.

The fourth exemplary embodiment has been explained based on the combination of the first exemplary embodiment and second exemplary embodiment, however, the third exemplary embodiment may be also combined.

Figure 30:
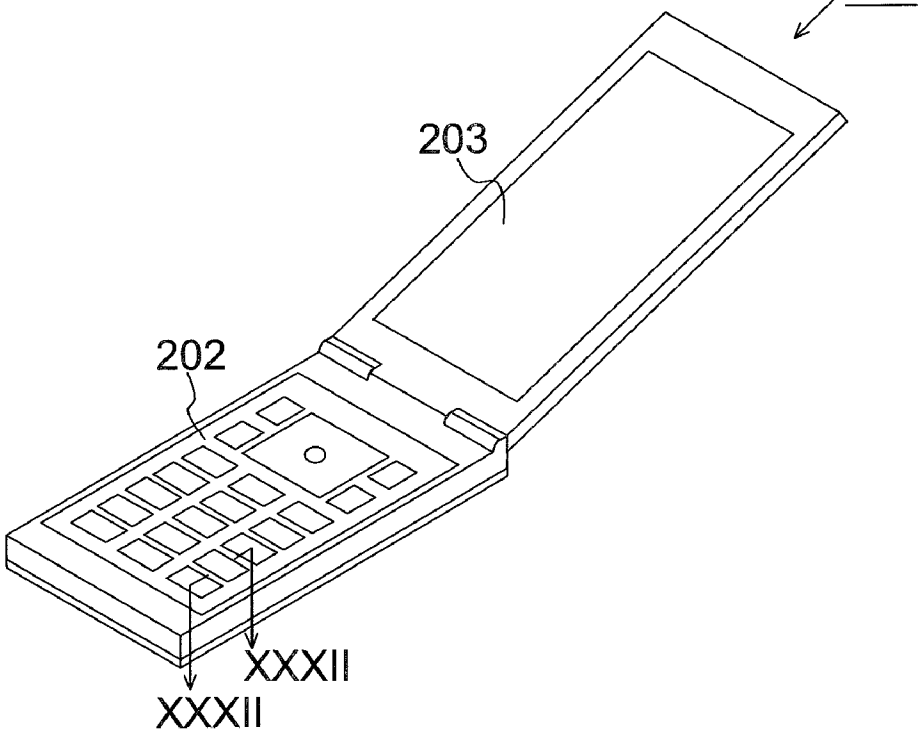
FIG. 30 is a schematic perspective view of an electronic device according to a fifth exemplary embodiment of the present invention.
Figure 31:
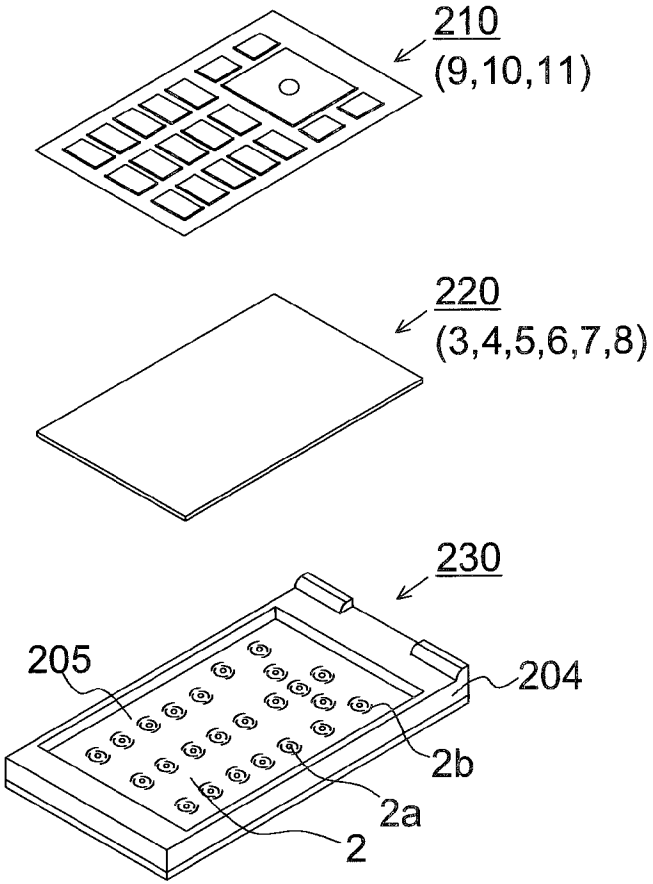
FIG. 31 is a schematically and partially exploded perspective view of an operation part of an electronic device illustrated in FIG. 30.
Figure 32:
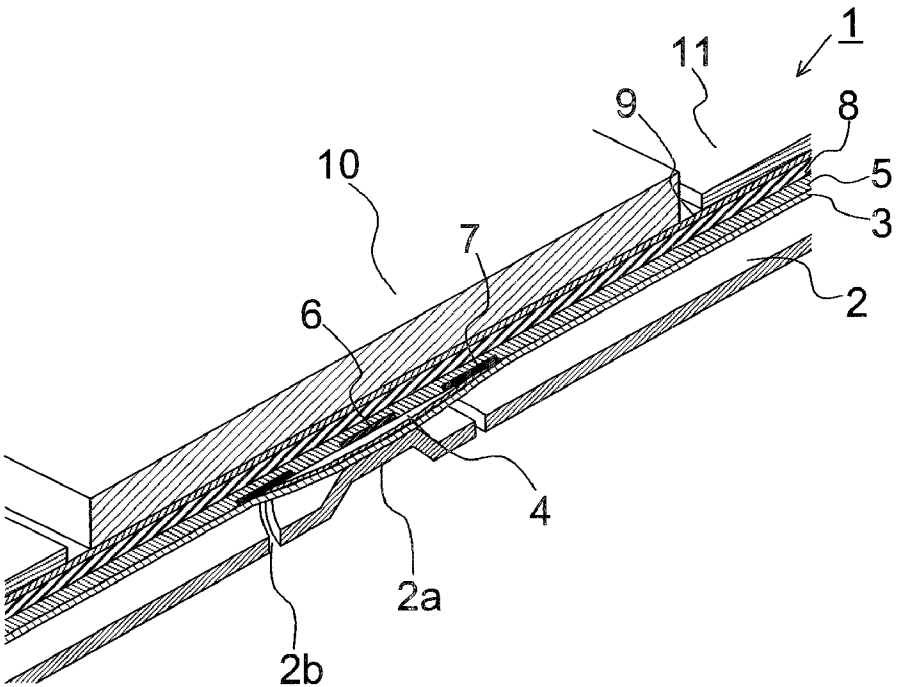
FIG. 32 is a schematic and partial cross-sectional view of a switch mechanism part along a XXXII-XXXII line in FIG. 30.

Next, an electronic device according to a fifth exemplary embodiment of the present invention will be explained. FIG. 30 illustrates a schematic perspective view of an electronic device according to the fifth exemplary embodiment of the present invention. In this exemplary embodiment, the electronic device of the present invention will be explained giving an example a mobile phone as the electronic device. An electronic device 201 illustrated in FIG. 30 is a folding mobile phone and has a operation part 202 and a display part 203. FIG. 31 illustrates a schematically and partially exploded perspective view of the operation part of the mobile phone illustrated in FIG. 30. FIG. 32 illustrates a schematic and partial cross-sectional view of the switch mechanism along a XXXII-XXXII line of FIG. 30.

The operation part 202 has the switch mechanism of the present invention. FIGS. 31 and 32 illustrate a mode in which the switch mechanism according to the first exemplary embodiment illustrated in FIGS. 1 and 2 is applied. The operation part 202, as illustrated in FIG. 31, is formed by layering a switch unit (the thin sheet 9, switch buttons 10, and cover member 11) 210, a circuit board unit (the adhesive sheet 3, conductors 4, circuit board 5, and illumination sheet 8) 220, and a housing unit (an outer housing 204 and inner housing 205) 230 to form a laminate. The housing unit 230 has the outer housing 204 and the inner housing 205 accommodating built-in components such as the switch mechanism and the like. The support board in the switch mechanism of the present invention corresponds to the base of the inner housing 205. A plurality of the projecting portions 2*a* and the through holes 2*b* to each projecting portion 2*a* are formed in the inner surface of the inner housing 205. The projecting portion 2*a* and through hole 2*b* are formed so as to correspond to the position of each switch button 10. By making a part of the inner housing 205 as the support board 2, great deformation of the support board 2 can be prevented as a whole even if the region where each through hole 2*b* is formed bends when the switch button is pushed. The inner housing 205 is preferably formed of stainless steel and the like.

According to the present invention, the illumination sheet 8, circuit board 5, conductor 4 and adhesive sheet 3 can be handled in one body as the circuit board unit 220, an inner structure of the electronic device 201 becomes simple, and the electronic device 201 becomes easy to be manufactured.

The electronic device of the present invention has been explained giving an example of the electronic device having the switch mechanism according to the first exemplary embodiment of the present invention, however, is not limited to this, and any mode of the switch mechanism of the present invention may be applied to the electronic device of the present invention.

EXAMPLE 1

In order to test the durability of the switch button in the switch mechanism of the present invention, a keystroke test was performed. In the keystroke test, the switch button was pushed repeatedly with a pushing member of a pillar-shaped body that is formed of an elastic body, such as a rubber material and the like, having a diameter of 5 mm to 10 mm like a human finger (as large as the surface of the switch button is covered wholly). The mode of the support board in the example is the same as the first exemplary embodiment illustrated in FIG. 2. A material of the support board is stainless steel having a thickness of 0.3 mm. As a comparison example, with regard to the support board without through hole as illustrated in FIG. 33, the test was also performed. Test results are shown in Table 1. The result shown in First Test Condition is a result that the keystroke test was performed by setting a keystroke load for an ordinary use. The result shown in Second Test Condition is a result that the keystroke test was performed by setting a keystroke load heavier than that for the ordinary use.

Under the First Test Condition, a crack(s) was generated by 28,000 keystrokes in the switch button of the switch mechanism without through hole, whereas no crack was generated by even 50,000 keystrokes in the switch button of the switch mechanism of the present invention having the through hole(s). Therefore, it was confirmed that the life of the switch button in the switch mechanism of the present invention having the through hole(s) was prolonged by 1.7 times or more the life of the switch button in the switch mechanism without through hole.

Under the Second Test Condition in which the load is heavier than that of First Test Condition, a crack(s) was generated by 2,000 keystrokes in the switch mechanism without through hole, whereas no crack was generated by even 20,000 or more keystrokes in the switch button of the switch mechanism of the present invention having the through hole(s). Therefore, it was confirmed that the life of the switch button in the switch mechanism of the present invention having the through hole(s) was prolonged by about 10 times or more the life of the switch button in the switch mechanism without through hole.

Therefore, it is confirmed that the life of the switch button can be prolonged by forming the through hole(s) to displace the projecting portion downward when the switch button is pushed.

TABLE 1

| | Example | Comparison Example |
|---|---|---|
| First Test Condition | 50,000 times or more | 28,000 times |
| Second Test Condition | 20,000 times or more | 2,000 times or less |

The switch mechanism of the present invention have been described based on the abovementioned exemplary embodiments, but there is no limitation to the abovementioned exemplary embodiments, and clearly various changes, modifications, improvements, and the like within the scope of the invention are included. Furthermore, various combinations, substitutions and selections of disclosed elements are possible within the scope of the present invention.

Further problems, objects and expanded modes of the present invention will become apparent from the entire disclosed matter of the present invention including the claims.

In the above exemplary embodiment, the electronic device to which the switch mechanism of the present invention may be applied has been explained giving the mobile phone as an example, however, an electronic device to which the switch mechanism of the present invention may be applied is not limited to the mobile phone, and the switch mechanism may be applied to various electronic devices such as a PDA (Personal Digital Assistants/Persona Data Assistants), potable audio device, remote-controller and the like.

EXPLANATION OF SYMBOLS

1, 141, 151, 161, 171, 181, 191 switch mechanism
2, 22, 32, 42, 52 support board
2*a*, 22*a*, 32*a*, 42*a*, 52*a* projecting portion
2*b*, 22*b*, 32*b*, 42*b*, 52*b* through hole
3, 192 adhesive sheet
4 conductor
4*a* central part
4*b* peripheral part
5, 152, 193 circuit board
6, 154 first electrode
7, 155 second electrode
8, 162, 194 illumination sheet
9 thin sheet
10 switch button
11 cover member
12, 159, 160, 182, 183, 184, 185, 186, 187, 188, 189 reinforcing member
153 substrate
153*a* through hole
156 ground electrode
157 insulating layer
158, 164, 173 conductive adhesive
163, 172 ground potential wiring
159*a* concave portion
160*a* convex portion
182*a*, 183*a*, 184*a*, 185*a*, 186*a*, 187*a*, 188*a*, 189*a* deforming supplementary portion
192*a* deforming supplementary portion
193*a* deforming supplementary portion
194*a* deforming supplementary portion
201 electronic device
202 operation part
203 display part
204 outer housing
205 inner housing
210 switch unit
220 circuit board unit
230 housing unit
401 switch mechanism
402 support board
402*a* projecting portion
403 adhesive sheet
404 conductor
405 circuit board
406 first electrode
407 second electrode
408 illumination sheet
409 thin sheet
410 switch button
411 cover member

The invention claimed is:

1. A switch mechanism comprising:

at least one switch button to be pushed;

a support board having at least one projecting portion at a position corresponding to said at least one switch button; and a switching assembly that is provided between said at least one switch button and said support board and that switches an electrical connection state with said at least one projecting portion in a state where said at least one switch button is pushed; wherein said support board comprises at least one through hole around a position corresponding to said at least one projecting portion; and said at least one through hole is formed such that said at least one projecting portion is displaced in a pushing direction of said at least one switch button in the state where said at least one switch button is pushed.

2. The switch mechanism according to claim 1, wherein said switching assembly has a circuit board that has a first electrode and a second electrode on one surface, and a conductor that is provided facing said one surface of said circuit board; and said conductor does not electrically connect said first electrode with said second electrode in a state where said at least one switch button is not pushed and electrically connects said first electrode with said second electrode by being supported with said at least one projecting portion in the state where said at least one switch button is pushed.

3. The switch mechanism according to claim 1, wherein when the state where the at least one switch button is pushed is released, the position of said at least one projecting portion is restored to an original position.

4. The switch mechanism according to claim 1, wherein in the state where said at least one switch button is pushed, said at least one projecting portion is displaced in the pushing direction by 0.05 mm to 0.15 mm.

5. The switch mechanism according to claim 1, wherein a plurality of said at least one through hole is formed so as to surround said at least one projecting portion.

6. The switch mechanism according to claim 1, wherein said at least one through hole has a spiral form and is formed so as to surround said at least one projecting portion.

7. The switch mechanism according to claim 1, wherein said at least one through hole is formed in a radial manner around said at least one projecting portion.

8. The switch mechanism according to claim 1, wherein said support board is made from stainless steel.

9. The switch mechanism according to claim 1, wherein said conductor has a dish shape;

a concave surface of said conductor faces said circuit board; and in the state where said at least one switch button is pushed, a part of said concave surface of said conductor is protruded in a direction of said circuit board by pushing of said at least one projecting portion, to bring said conductor into contact with said first electrode.

10. The switch mechanism according to claim 1, wherein said at least one switch button is made from resin.

11. An electric device comprising:

a switch mechanism; wherein said switch mechanism comprises:

at least one switch button to be pushed;

a support board having at least one projecting portion at a position corresponding to said at least one switch button and a switching assembly that is provided between said at least one switch button and said support board and that switches an electrical connection state with said at least one projecting portion in a state where said at least one switch button is pushed;

said support board comprising at least one through hole around a position corresponding to said at least one projecting portion; and said at least one through hole being formed such that said at least one projecting portion is displaced in a pushing direction of said at least one switch button in the state where said at least one switch button is pushed.

12. The electronic device according to claim 11, wherein said switching assembly has a circuit board that has a first electrode and a second electrode on one surface, and a conductor that is provided facing said one surface of said circuit board; and said conductor does not electrically connect said first electrode with said second electrode in a state where said at least one switch button is not pushed and electrically connects said first electrode with said second electrode by being supported with said at least one projecting portion in the state where said at least one switch button is pushed.

13. The electronic device according to claim 11, wherein said support board is a part of a housing that accommodates at least one built-in component of the electronic device.

* * * * *